US006762014B2

(12) United States Patent
Takeyama

(10) Patent No.: US 6,762,014 B2
(45) Date of Patent: Jul. 13, 2004

(54) IMAGE FORMING MATERIAL

(75) Inventor: Toshihisa Takeyama, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/449,999

(22) Filed: May 30, 2003

(65) Prior Publication Data

US 2003/0232290 A1 Dec. 18, 2003

(30) Foreign Application Priority Data

Jun. 6, 2002 (JP) ..... 2002-165909

(51) Int. Cl.[7] ..... G03C 1/498; G03C 1/76
(52) U.S. Cl. ..... 430/523; 430/531; 430/533; 430/534; 430/535; 430/536; 430/944
(58) Field of Search ..... 430/523, 619, 430/531, 533, 534, 535, 536, 944; 503/200

(56) References Cited

U.S. PATENT DOCUMENTS 6,420,102 B1 * 7/2002 Bauer et al. ..... 430/350

* cited by examiner

*Primary Examiner*—Thorl Chea
(74) *Attorney, Agent, or Firm*—Muserlian, Lucas and Mercanti

(57) ABSTRACT

An image forming material is disclosed, comprising a support having thereon an image forming layer containing a light-insensitive organic silver salt and a reducing agent and a protective layer in that order, wherein the image forming layer or the protective layer contains a binder having a structure unit represented by the following formula in which Z is a divalent linkage group, $R_1$ is a hydroxyl group, an alkyl group containing a hydroxyl group or an aryl group containing a hydroxyl group.

12 Claims, No Drawings

IMAGE FORMING MATERIAL

FIELD OF THE INVENTION

The present invention relates to an image forming material, in particular to a silver salt image forming material exhibiting reduced bleeding-out and an image forming method by the use of the same.

BACKGROUND OF THE INVENTION

In the field of graphic arts and medical treatment, there have been concerns in processing of photographic film with respect to effluent produced from wet-processing of image-forming materials, and recently, reduction of the processing effluent is strongly demanded in terms of environmental protection and space saving. In view of the foregoing, there has been desired a system using no processing solution. For example, techniques of thermographic image-forming materials comprising light-insensitive organic silver salt and a reducing agent are disclosed in U.S. Pat. Nos. 3,887,378, 4,013,473, 5,416,058, 5,582,953, 5,587,350, 5,734,411, 5,734,412, 5,759,752, 5,817,598, 6,093,528, 6,211,116, 6,244,766 and 6,313,965. Onto these image-forming materials, digital recording can be conducted in response to image signals, using a thermal head and light-to-heat convertible laser light.

There is known a thermally developable photographic materials comprising on a support an organic silver salt, light-sensitive silver halide and a reducing agent, as described in U.S. Pat. Nos. 3,152,904 and 3,487,075, and D. H. Klosterboer, "Dry Silver Photographic Materials" in Handbook of Image-forming Materials page 48 (Marcel Dekker, 1991). These image-forming materials render possible formation of distinct black images exhibiting high sharpness, enabling efficient exposure by means of a laser imager or a laser image setter.

The foregoing image-forming materials provide a simply and environment-friendly system for users, without using any processing solution. However, in any of the image-forming materials, imagewise heating or heat development often causes bleed-out of compounds such as an organic acid formed from an organic silver salt, on the surface of the image-forming material, thereby producing problems such as staining of rolls or filters installed in the interior of a thermal printer or laser image and white powder adhesion onto finger of users employing this image-forming material.

To improve defects described above, various compositions for a protective layer and image-forming materials having various layer arrangements have been proposed in thermographic materials, as described in European Patent 0,614,769 and 0,726,852; U.S. Pat. Nos. 6,350,561, and 6,352,819, 6,352,820, and image-forming materials containing light-sensitive silver halide, as described in U.S. Pat. Nos. 6,350,561, 6,352,820; and JP-A Nos. 2000-267226, 2000-284416, 2000-292883, 2000-347339 and 2001-13624) hereinafter, the term, JP-A refers to Japanese Patent Application Publication).

However, bleeding-out of compounds on the surface was not completely prevented in the foregoing image-forming materials.

SUMMARY OF THE INVENTION

Accordingly, it is an object of the present invention to an image-forming material improved in bleed-out of a compound on the surface, caused in imagewise heating or heat development after imagewise exposure, and an image-forming method by use the same.

The foregoing object can be accomplished by the following constitution:

An image-forming material comprising a support having thereon an image-forming layer containing a light-insensitive organic silver salt and a reducing agent and a protective layer in that order, wherein the image-forming layer or protective layer comprises a binder having a structure unit represented by the following formula (1) or (2):

formula (1)

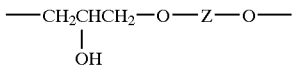

formula (2)

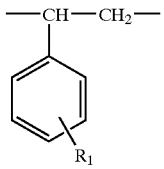

wherein Z represents a divalent linkage group, $R_1$ represents hydroxyl group, a substituted or unsubstituted alkyl group containing a hydroxyl group, or a substituted or unsubstituted aryl group containing a hydroxyl group.

DETAILED DESCRIPTION OF THE INVENTION

One embodiment of this invention concerns an image-forming material comprising a support having thereon an image-forming layer containing a light-insensitive organic silver salt and a reducing agent, and a protective layer in that order.

Further, another embodiment of this invention concerns an image-forming material comprising a support having thereon an image-forming layer containing a light-sensitive silver halide, a light-insensitive organic silver salt and a reducing agent, and a protective layer in that order.

Next, embodiments of this invention will be described. One aspect of this invention is directed to an image-forming material comprising a support having thereon an image-forming layer containing a light-insensitive organic silver salt and a reducing agent, and a protective layer in this order, wherein at least one of the image-forming layer and the protective layer contains at least one binder resin comprising a structural unit represented by the foregoing formula (1) or (2), as a structure unit (or repeating unit).

In the formula (1), Z represents a divalent linkage group; in the formula (2), $R_1$ represents hydroxyl group, an alkyl group containing a hydroxyl group, which may be substituted, or an aryl group containing a hydroxyl group, which may be substituted.

The alkyl group represented by $R_1$ is a straight chain, branched or cyclic alkyl group, preferably having 1 to 30 carbon atoms, and more preferably 1 to 20 carbon atoms. The alkyl group may be substituted and any substituent giving no adverse effect in the imaging process relating to this invention can be introduced. Examples of such a substituent include a halogen atom, alkenyl group, alkynyl group, aryl group, heterocyclic group (including a N-substituted nitrogen-containing heterocyclic group, such as morpholine group), alkoxycarbonyl group, aryloxycarbonyl group, carbamoyl group, imino group, N-substituted imino group, carbazoyl group, cyano group, thiocarbamoyl group, aryloxy group, heterocyclic-oxy group, acyloxy group, (alkoxy- or aryloxy-)carbonyloxy group, sulfonyloxy group, acylamido group, sulfonamido group, ureido group, thioureido group, imido group, (alkoxy- or aryloxy-) carbonylamino group, sulfamoylamino group, semicarbazide group, thiosemicarbazide group, (alkyl- or aryl-) sulfonylureido group, nitro group, (alkyl- or aryl-)sulfonyl group, sulfamoyl group, group having a phosphoric acid amide or phosphoric acid ester structure, and silyl group. These substituents may further be substituted.

The aryl group represented by $R_1$ may be a single ring or condensed ring aryl group, preferably having 6 to 24 carbon atoms, and more preferably 6 to 20 carbon atoms. Examples thereof include phenyl, naphthyl, anthracenyl, naphthacenyl and triphenylenyl. The aryl group may be substituted and any substituent giving no adverse effect in the imaging process relating to this invention can be used. Examples of such a substituent include a halogen atom, alkenyl group, alkynyl group, aryl group, heterocyclic group (including a N-substituted nitrogen-containing heterocyclic group, such as morpholine group), alkoxycarbonyl group, aryloxycarbonyl group, carbamoyl group, imino group, N-substituted imino group, carbazoyl group, cyano group, thiocarbamoyl group, aryloxy group, heterocyclic-oxy group, acyloxy group, (alkoxy- or aryloxy-)carbonyloxy group, sulfonyloxy group, acylamido group, sulfonamido group, ureido group, thioureido group, imido group, (alkoxy- or aryloxy-) carbonylamino group, sulfamoylamino group, semicarbazide group, thiosemicarbazide group, (alkyl- or aryl-) sulfonylureido group, nitro group, (alkyl- or aryl-)sulfonyl group, sulfamoyl group, group having a phosphoric acid amide or phosphoric acid ester structure, and silyl group. These substituents may further be substituted.

The binder resin comprising a structural unit represented by formula (2) can be obtained by polymerization of a monomer having the following structure. However, embodiments of this invention is not limited to these and any binder resin having a structural unit falling the scope of this invention is usable in this invention.

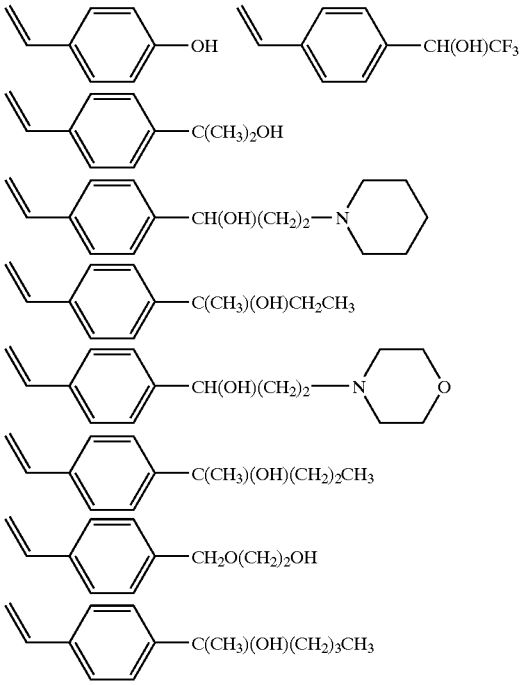

-continued

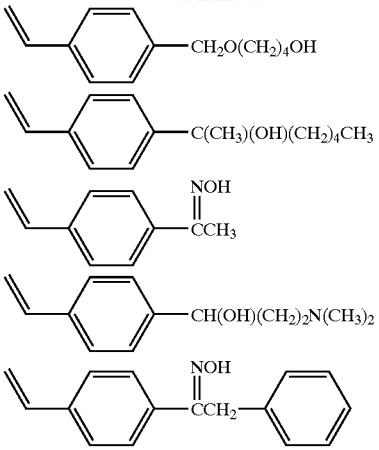

A binder resin obtained from monomers described above may be a homopolymer obtained by polymerizing a single monomer or a coploymer obtained by alternating polymerization, random polymerization or block polymerization with other monomers. Such other monomers containing an unsaturated double bond include, for example, olefins such as ethylene and isoprene; styrenes such as 4-methylstyrene; vinyl esters such as vinyl acetate and vinyl propionate; cyclic unsaturated compounds such as anhydrous maleic acid and N-phenylmaleimide; acrylonitrile; vinyl chloride; monofunctional acrylic acid esters and their derivatives such as 2-ethylhexylacrylate; bi-functional acrylic acid esters such as pentaerythritol diacrylate and bisphenol A diacrylate; polyfunctional acrylic acid esters and their derivatives such as trimethylol propane tri(metha) acrylate, dipentaerythritol pentaacrylate and dipentaerythritol hexaacrylate. Further, there are also usable so-called pre-polymers, in which acrylic acid or methacrylic acid is introduced into an oligomer having an appropriate molecular weight. In addition to the foregoing, there are usable acryl type compounds described in "11290 Chemical Goods" page 286–294, Kagaku Kogyo Nipposha; "UV and EB Hardening Handbook (Raw Material)" page 11–65, Kobunshikankokai.

The resin comprising a structural unit represented by the above-described formula (1) can be obtained by subjecting a compound containing two hydroxyl groups and epichlohydrin to condensation reaction. Any compound containing two hyxroxy groups which is capable of causing condensation reaction with an epichlorohydrin having a structural unit falling the scope of this invention is usable without specific limitation. Examples of such a compound include diols such as 1,4-dihydroxylcyclohexane, 1,4-dihydroxylnaphthalene, 1,5-dihydroxylnaphthalene, 4,4'-dihydroxylbiphenyl, and 2,2'-bis(4-hydroxylcyclohexyl)propane.

In the structure unit represented by the formula (1), Z is preferably represented by the following formula (3):

formula (3)

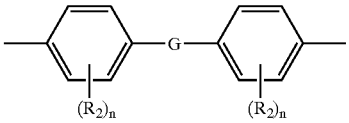

wherein G represents —O—, —S—, —SO—, —$SO_2$—, —CO—, or a substituted or unsubstituted alkylene or arylene group; $R_2$ represents a hydrogen atom, a halogen atom, an alkyl group, which may be substituted, or an aryl group, which may be substituted, provided that G and $R_2$ may combine with each other to form a ring; n is an integer of 0 to 4. The alkyl and aryl groups represented by $R_2$ are each the same as defined in $R_1$ in the foregoing formula (1).

When Z is represented by formula (3), an obtained binder resin has a higher glass transition temperature and is preferable in this invention.

Specific examples of Z represented by the formula (3) are shown below but are by no means limited to these.

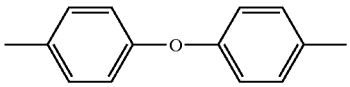

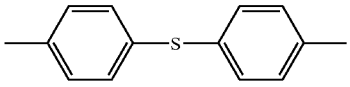

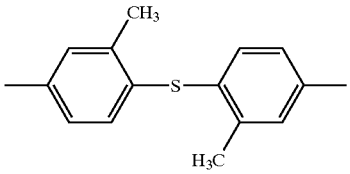

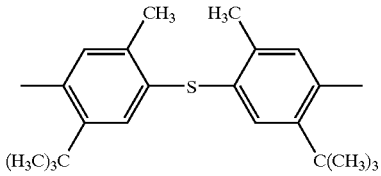

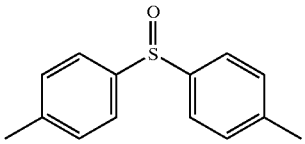

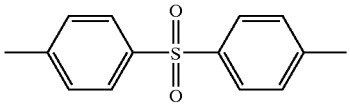

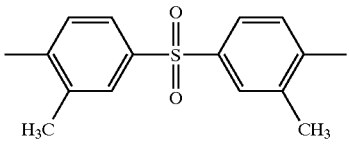

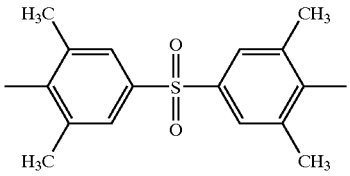

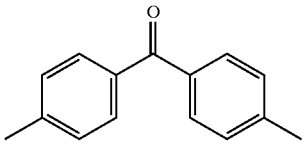

-continued

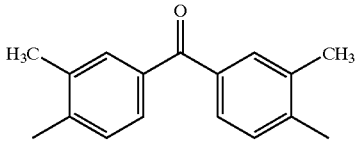

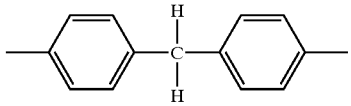

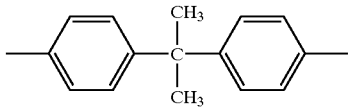

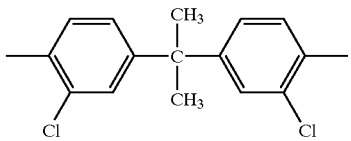

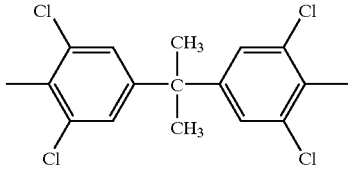

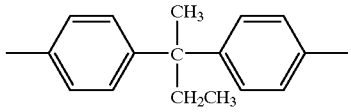

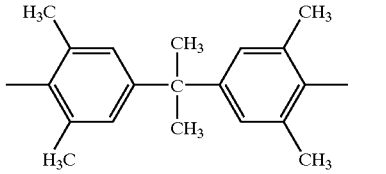

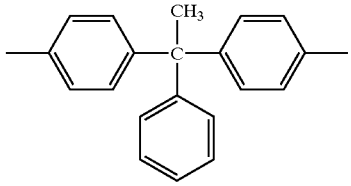

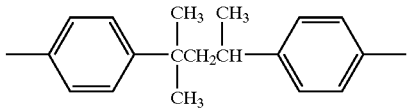

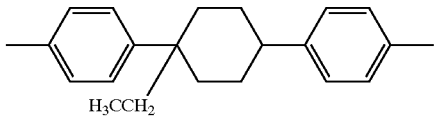

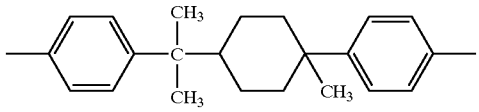

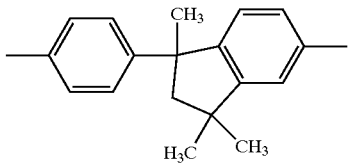

-continued

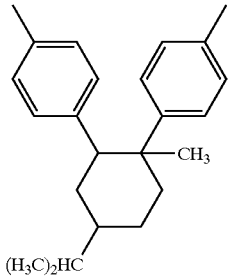

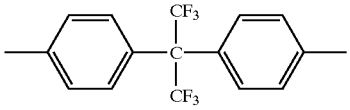

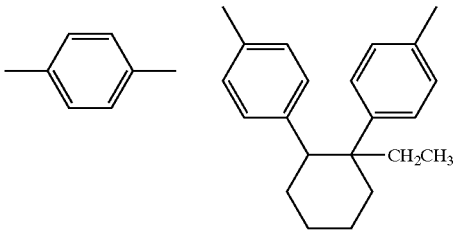

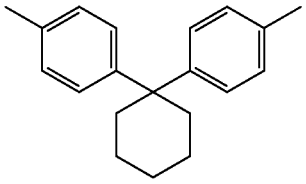

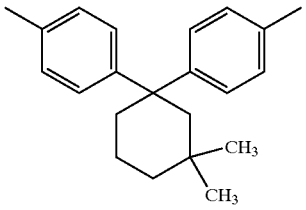

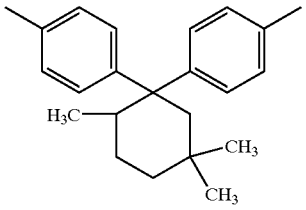

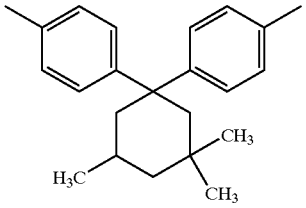

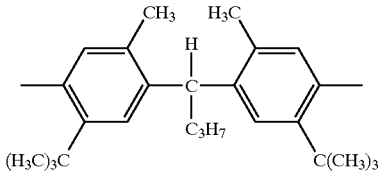

-continued

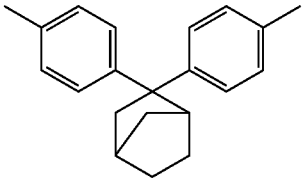

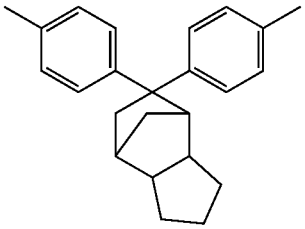

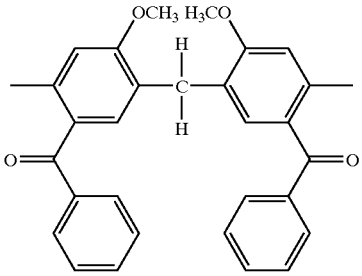

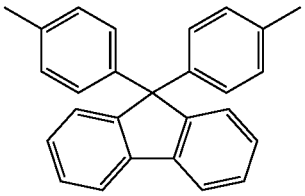

Of structural units represented by the formula (3), one represented by the following formula (4) is more preferred in terms of solubility in coating solvents:

formula (4)

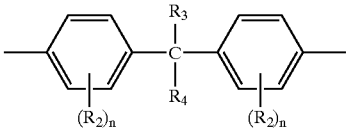

wherein $R_3$ and $R_4$ represent a substituted or unsubstituted alkyl or aryl group, provided that $R_3$ and $R_4$ may combine with each other to form a ring; $R_2$ is a hydrogen atom, a halogen atom, an alkyl group or an aryl group, provided that $R_2$ and $R_3$, or $R_2$ and $R_4$ may combine with each other to form a ring; n is an integer of 0 to 4. Herein, the alkyl group and aryl group represented by $R_3$ and $R_4$ are the same as defined in $R_1$ of the foregoing formula (1).

Specific examples of the binder resin having the structure unit represented by the foregoing formulas (1) through (4) are shown below but are not limited to these.

B-1
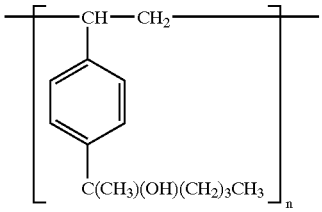
Tg 85°C.
B-2
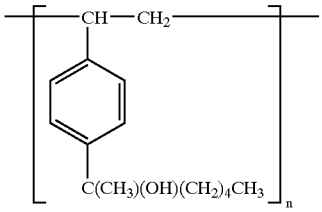
Tg 95°C.
B-3
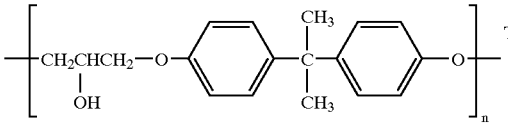
Tg 95°C.
B-4
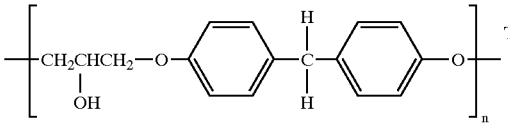
Tg 80°C.
B-5
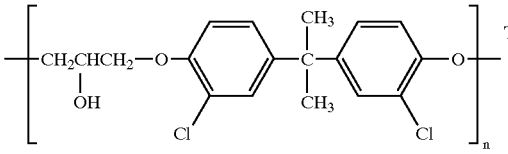
Tg 85°C.
B-6
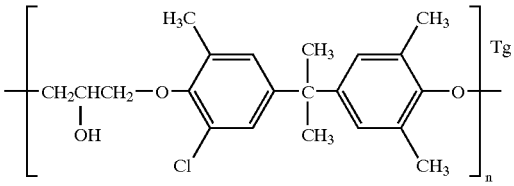
Tg 130°C.
B-7
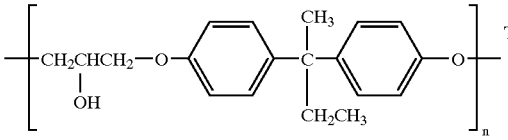
Tg 95°C.
B-8
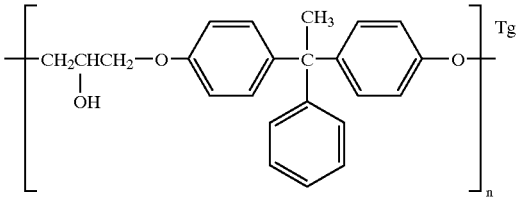
Tg 115°C.
-continued
B-9
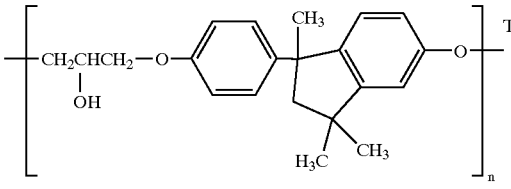
Tg 120°C.
B-10
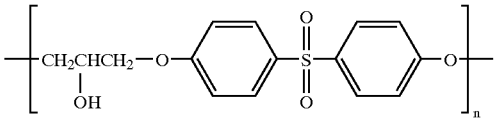
Tg 165°C.
B-11
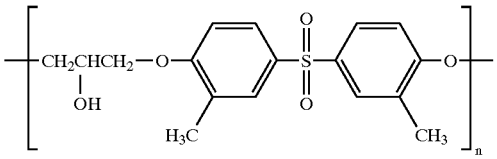
Tg 135°C.
B-12
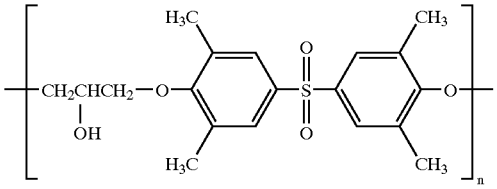
Tg 145°C.
B-13
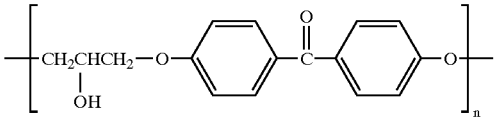
Tg 130°C.
B-14
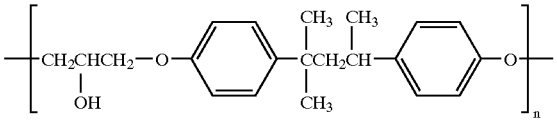
Tg 75°C.
B-15
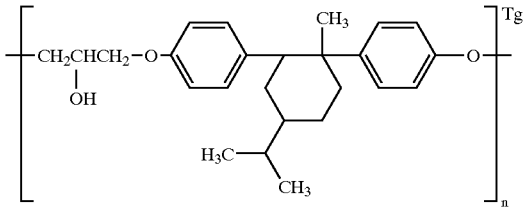
Tg 175°C.
B-16
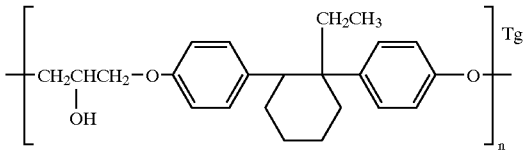
Tg 140°C.

-continued

B-17

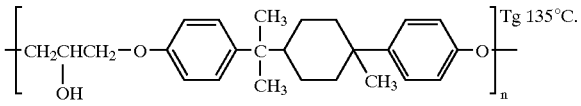

B-18

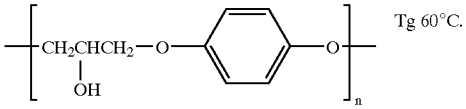

The binder resin comprising the structural unit described above, which contains a hydroxyl group can be highly cross-linked using a hardening agent, thereby preventing bleed-out of compounds on the surface.

Cross-linking agents capable of cross-linking binder resins having the structural unit described above include any one capable of crosslinking hydroxyl groups. Examples thereof include isocyanate compounds, carbodiimide compounds and metal alkoxides. Of these, isocyanate compounds are preferred in terms of easily controllable reactivity.

Of isocyanate compounds, polyisocyanate compounds having at least two isocyanate groups in the molecule are preferred in to enhance a cross-linking density. Examples thereof include dimethylenediisocyanate, tetramethylenediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, isophoronediisocyanate, 1-methylcyclohexyl-2,4-diisocyanate, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. These isocyanate compounds may be used singly or in their combination.

Binder resins having a structure unit represented by formula (1) or (2), including formulas (3) and (4) may be incorporated into either or both of the image-forming layer and protective layer. To minimize compound bleed-out on the surface, it is preferred to cross-link the binder resin. As described later, the binder resin is preferably incorporated into the protective layer to achieve sufficiently high density per a given amount of energy applied when imagewise heated in the image-forming method, as detailed later. In cases when the binder resin having the foregoing structural unit is incorporated into the protective layer, a glass transition temperature of the resin preferably is not less than 70° C., and a content of the resin in the protective layer preferably 40 to 100%, and more preferably 50 to 99% by weight, based on the protective layer. In cases when contained in the image-forming layer, the content of the binder resin is preferably 0.1 to 20%, and more preferably 0.5 to 10% by weight, based on the image-forming layer.

In one preferred embodiment of this invention, the image-forming material comprises a support having thereon an image-forming layer containing a light-insensitive organic silver salt and a reducing agent, and a protective layer in that order, wherein the protective layer contains a binder resin having at least three hydroxyl groups and exhibits a solubility parameter (designated as δp) of $21.5 \leqq \delta p \leqq 20.0$ $(J/cm^3)^{0.5}$.

In this invention, the hydroxyl group refers to a functional group containing at least one —OH and examples thereof include —OH, $—SO_3H$, $—OSO_3H$, —COOH and $—PO(OH)_2$.

The solubility parameter (δp) is commonly known in the art and defined as below. Thus, cohesive energy (Δei) and molar volume (Δvi) are determined for each of unit functional groups and summed, and the solubility parameter is determined according to the following equation (1):

$$\delta p=[\Sigma(\Delta ei)/\Sigma(\Delta vi)]^{1/2} \quad (1).$$

The solubility parameter is detailed, for example, in Polymer Engineering and Science, 14 (2) 147 (1974); "Polymer Handbook, fourth edition" 675 (John Wiley & Sons, Inc. 1998).

The image-forming material according to this invention is imagewise heated and a light-insensitive organic silver salt contained as one of the essential components is allowed to react with a reducing agent contained in the image-forming layer to form a silver image and an organic acid.

In general, long chain organic acids are broadly employed as a surfactant and lubricant in various fields. This utilizes the fact that solubility parameters of organic acids are relatively low in solution or in a solid phase. In other words, the more substances differing in solubility parameter from the organic acid exist in the surroundings, the more easily separation occurs. Therefore, incorporating into the protective layer a binder resin which differs greatly in solubility parameter from an organic acid produced after imagewise heating, prevents bleed-out of the organic acid on the outermost surface.

In one embodiment of this invention, organic solvents having a solubility parameter of 15.0 to 30.0 are used as a solvent for a protective layer coating solution, so that a resin having a large solubility parameter (δp), in other words, a resin exhibiting high hydrophilicity such as water-soluble resin is not soluble. Accordingly, a binder resin having a solubility parameter (δp) of not more than 29.0 is preferred in terms of solubility in solvent.

In light of calculated values of the solubility parameter of straight chain fatty acids, e.g., myristic acid (18.79), stearic acid (18.68), arachidic acid (18.57) and behenic acid (18.48), the solubility parameter of a binder resin preferably is not less than 20.0, and more preferably not less than 21.5 to increase the difference in solubility parameter from an organic acid. The content of the resin in the protective layer composition preferably is 50 to 100%, and more preferably 60 to 99% by weight.

Further, incorporation of a cross-linking agent capable of cross-linking a binder resin contained in the protective layer is preferable to enhance effects of this invention. Considering miscibility of a cross-linking agent with a binder resin contained in the protective layer, it is preferred to select a cross-linking agent meeting the following requirement:

$$0.8 \leqq \delta h/\delta p \leqq 1.3$$

where δh is the solubility parameter of the cross-linking agent and δp is the solubility parameter of the binder resin.

Resins containing at least three hydroxyl groups in the molecule and having a solubility parameter (δp) falling within the range of $21.5 \leqq \delta p \leqq 28.0$ include modified resins in which a hydroxyl group or a functional group of a carboxylic acid, sulfonic acid or phosphoric acid is introduced into polyurethane type resin, polyester type resin, polyvinyl acetal type resin, cellulose type resin, phenoxy type resin, epoxy type resin, phenol novolak type resin, polycarbonate resin, acryl type resin, polystyrene type resin, polyolefin type resin, polyvinyl chloride type resin, silicone resin and the like, and binder resins of this invention, as defined earlier. These resins may be used singly or in combination.

Cross-linking agents containing an isocyanate group are usable in the afore-mentioned binder resins containing at least one functional group selected from —OH, —$SO_3H$, —$OSO_3H$, —COOH and —$PO(OH)_2$; hardening agents containing a carbodiimide group, in binder resins containing at one functional group selected from —OH, and —COOH; and cross-linking agents containing an oxazoline group, in binder resins containing —COOH. Further, metal alkoxides of Si, Ti, Zr or Al are also usable unless the intended cross-linking of resins is adversely affected.

Of the foregoing cross-linking agents, isocyanate compounds are preferred in terms of controlling reactivity such as cross-linking temperature and time. The solubility parameter of such an isocyanate compound can be calculated using values shown in the literature described earlier, and values of some isocyanate compounds are also calculated in "Coating Jiho" No. 193, 9 (1992).

Preferred isocyanate crosslinking agents are isocyanate compounds containing at least two isocyanate group and their adducts. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56–5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, adduct of isocyanate and polyhydric alcohol improves adhesion between layers, exhibiting high capability of preventing layer peeling, image slippage or production of bubbles.

In one preferred embodiment of this invention, the image-forming material comprises a support having thereon an image-forming layer containing a light-insensitive organic silver salt and a reducing agent, and a protective layer in that order, wherein the protective layer contains a binder resin having a hydroxyl value of 150 to 350 mg KOH/g. The hydroxyl value is a value which is determined according to the method described in "Plastic Handbook (Revised edition)" pages 812–813 (Asakura Shoten).

A binder resin having a hydroxyl value of 150 to 350 mg KOH/g can be cross-linked by cross-linking agents capable of cross-linking with a hydroxyl group, such as an isocyanate compound, a carbodiimide compound, and a metal alkoxide. Cross-linking the protective layer minimizes microscopic thermal deformation upon heating and reduces the amount of bleeding compounds on the surface. A binder resin having a hydroxyl value exceeding 350 mg KOH/g results in increased hydrophilicity and often becomes insoluble in a solvent. A binder resin having a hydroxyl value of less than 150 mg KOH/g reduces provability of the binder resin being in contact with a cross-linking agent, resulting in an insufficient cross-linking effect.

In this invention, the hydroxyl value of a binder resin contained in the image-forming layer is preferably 100 to 300 mg KOH/g to disperse a light-insensitive organic silver salt in a coating solution or to maintain homogeneity of the salt in a coated layer. A binder resin contained in the image-forming layer, having a hydroxyl value of less than 100 mg KOH/g lowers homogeneity of the organic silver salt dispersed in the coating solution or coated layer. A hydroxyl value of more than 300 mg KOH/g often results in markedly increased viscosity of the coating solution.

In embodiments of this invention, binder resins usable in the protective layer or image-forming layer can be selected from resins having a hydroxyl value as defined above. Its content in the protective layer preferably is 50 to 100%, and more preferably 60 to 99% by weight. Cross-linking agents can also be selected from those described earlier. Binder resins or cross-linking agents contained in the protective layer or image-forming layer can be respectively used singly or in combination.

In one preferred embodiment of this invention, a hydroxyl value (A) of a binder resin contained in the image-forming layer and a hydroxyl value (B) of a binder contained in the protective layer meet the relationship of $0.5 \leqq B/A \leqq 3.5$. In the case of $B/A<0.5$ or $B/A>3.5$, adhesion between the protective layer and the image-forming layer is deteriorated, often causing peel-off of the layer at the time of cutting image-forming material.

In this embodiment, it is preferred to incorporate a cross-linking agent into either the image-forming layer or the protective layer. To meet the range of $0.5 \leqq B/A < 1.0$, it is preferred that the cross-linking agent incorporated into the protective layer be more reactive than that incorporated into the image-forming layer. In the case of $1.0 \leqq B/A \leqq 3.5$, it is preferred to use a cross-linking agent in the protective layer, having a higher or substantially equivalent reactivity, relative to a cross-linking agent used in the image-forming layer. Meeting the foregoing relationship results in sufficient cross-linking of the protective layer, thereby minimizing microscopic thermal deformation upon heating and reducing the bleeding amount of compounds onto the surface. To secure cross-linking of the protective layer, it is preferred to use a binder having a hydroxyl value of 150 to 350 mg KOH/g, leading to sufficient cross-linking with a cross-linking agent. In this case, a binder resin having a hydroxyl value exceeding 350 mg KOH/g results in increased hydrophilicity and often becomes insoluble in a solvent, and a binder resin having a hydroxyl value of less than 150 mg KOH/g reduces provability of the binder resin being in contact with a cross-linking agent, resulting in insufficient cross-linking effects.

In embodiments of this invention, a binder resin used in the protective layer can be selected from resins described earlier. The resin content in the protective layer is preferably 50 to 100%, and more preferably 60 to 99% by weight. Cross-linking agents can also be selected from those described earlier. Binder resins or cross-linking agent contained in the protective layer can be respectively used alone or in combination.

A binder resin used in the image-forming layer preferably is a resin containing hydroxyl group, carboxyl group or its salt, or sulfonic acid group or its salt. Examples thereof include polyvinyl acetal type resin, cellulose type rein, phenoxy resin; modified resin having introduced functional group described above, such as modified vinyl chloride type resin, modified polyester resin, modified polyurethane resin, modified epoxy resin and modified acryl type resin. These resins may be used alone or in combination.

In this invention, a cross-linking agent having a solubility parameter ($\delta h2$) falling within the range of $21.5 \leqq h2 \leqq 29.5$ is preferable in terms of miscibility with a binder.

Next, there will be described a support, an image-forming layer comprising a light-insensitive organic silver salt and a reducing agent, and a protective layer.

Examples of synthetic resin forming a support used in photothermographic materials include acryl type resin, polyester, polycarbonate, polyalylate, poly(vinyl chloride), polyethylene, polystyrene, nylon, aromatic polyamide, poly (ether ether ketone), polystyrene, polyethersulfone, polyimide, polyetherimide, and triacetyl cellulose. There are also employed resin films comprised of two or more layers of the foregoing resin(s).

In the image recording process relating to the invention, after latent image formation, thermal development is conducted to form images, so that a support, which has been stretched in the form of film, followed by being subjected to annealing is preferable in terms of dimensional stability. Of the resins described above, polyester, polycarbonate, polyalylate, poly(ether ether ketone) and triacetyl cellulose are preferred and polyester that has been subjected to bi-axial stretching and annealing is specifically preferred in terms of general purpose and cost.

Polyester will be further detailed. The polyester refers to a polymeric compound having a ester bonding in the main chain, which are obtained by condensation polymerization of a diol and dicarboxylic acid. Examples of the dicarboxylic acid include terephthalic acid, isophthalic acid, phthalic acid, naphthalene-dicarboxylic acid, adipinic acid, and sebacic acid. Examples of the diol include ethylene glycol, trimethylene glycol, tetramethlene glycol and cyclohexane dimethanol. In the invention are preferably employed polyethylene terephthalate (PET) and its copolymer, polybutylene naphthalate (PBN) and its copolymer, polybutylene terephthalate (PBT) and its copolymer, and polyethylene naphthalate (PEN) and its copolymer. In these polyesters, the number of repeating units are preferably not less than 100, and more preferably not less than 150; the intrinsic viscosity is preferably not less than 0.6 dl/g and more preferably not less than 0.7 dl/g, thereby leading to superior film-making stability. Into these polyesters can be compounded commonly known additives such as a lubricant, stabilizer, antioxidant, viscosity-adjusting agent, antistatic agent, colorant and pigment. The thickness of the support is usually 50 to 500 $\mu$m, and preferably 100 to 250 $\mu$m.

In cases where the photothermographic material is used for clinical images, the foregoing supports may be blue-tinted. Usable dyes include, for example, a disperse dye, cationic dye, basic dye, acid dye, reactive dye, direct dye, vat dye, azoic dye, mordant dye, acid mordant dye, union dye and solvent dye. Of these dyes, the solvent dye is preferable in terms of uniform dispersibility at the stage of melt kneading in the manufacturing process of supports and dye solubility at the time of preparing a coating solution for a backing layer. Heat resistance is preferably 250° C. or higher, in which no sublimation occurs at the time of melt kneading and deterioration of the dye during kneading is reduced. Specifically, in cases when the temperature of a extrusion machine is needed to be raised to 300° C. to extrude resin for use in supports, the heat resistance is preferably 280° C. or higher. Dyes having $\lambda$max at 600 to 650 nm is preferable for blue-tinting.

On the opposite side of the support to the image-forming layer, a backing layer may be provided for the purpose of transportability, antistatic property and antihalation. The backing layer is comprised of a binder resin and optionally of various additives. As binder resin forming the backing layer are optionally employed commonly known transparent or translucent resins, including, for example, poly(vinyl acetal) type resin such as poly(vinyl formal), poly(vinyl acetoacetal) and poly(vinyl butyral); cellulose type resin such as nitrocellulose, and cellulose acetate butyrate; styrene type resin such as polystyrene, copolymer of styrene and acrylonitrile, and copolymer of styrene, acrylonitrile and acryly rubber; acryl type resin such as poly(methyl methacrylate); polyester, polyurethane, polalylate, epoxy resin and phenoxy resin. Furthermore, an epoxy group containing compound and acryl group containing compound that are actinic ray-hardenable may also employed as a layer forming resin. These binder resins may be used alone or in combination thereof. Specifically, hydroxy group-containing resin may be cross-linked with cross-linking agents such as a poly-functional isocyanate compound or a metal alkoxide such as alkoxy-silane compound or alkoxy-titanium compound, which contains plural metal alkoxide moieties.

There may be incorporated a filler to prevent troubles in pick-up or maintain transportability. Specific examples thereof include inorganic fillers such as $SiO_2$, $TiO_2$, $BaSO_4$, ZnS, $MgCO_3$, $CaCO_3$, ZnO, CuO, CaO, $WS_2$, $MoS_2$, MgO, $SnO_2$, $Al_2O_3$, $\alpha$-$Fe_2O_3$, $\alpha$-$FeO_2H$, SiC, $CeO_2$, MoC, BC, WC, BN, SiN, Titanium carbide, corundum, artificial diamond, garnet, silica, diatomaceous and dolomite, and organic fillers such as polyethylene particles, fluororesin particles, guanamine resin particles, acryl resin particles, silicone resin particles, melamine resin particles, and silk powder. The filler content preferably is 0.05 to 30% by weight, based on the backing layer. A lubricant or a antistatic may be incorporated in the backing layer to improve lubrication property and antistatic property. Examples of the lubricant include a fatty acid, fatty acid ester, fatty acid amide, polyoxyethylene, polyoxypropylene, (modified) silicone oil, (modified) silicone resin, (modified) fluorinated compound, (modified) fluorinated resin, fluorinated resin, fluoro-carbon, and wax. Examples of antistatic include a cationic surfactant, anionic surfactant, nonionic surfactant, polymeric antistatic agent, metal oxide and conductive polymer, compounds described in "11290 no Kagaku-shohin" (11290 Chemical Goods), published by Kagakukogyo-Nippo-Sha at page 875 to 876, and compounds described in U.S. Pat. No. 5,244,773, col. 14 to 20. A compound having absorption with the oscillation wavelength region of laser used in the image recording process relating to the invention, as described later may be incorporated as an antihalation agent. The backing layer thickness is usually 0.5 to 25 $\mu$m, and preferably 1.0 to 15 $\mu$m. The backing layer may be comprised of single layer or plural layers. Furthermore, an antistatic layer may be interposed between the backing layer and the support to enhance antistatic property and the support surface of the backing layer side may be subjected to corona discharge, plasma discharge or anchor coat treatment to enhance adhesion property or coating property of the backing layer.

Next, light-insensitive organic silver salts and reducing agents contained as the essential components in the image-forming layer will be described further in detail.

Light-insensitive organic silver salts usable in this invention preferably are silver salts of organic carboxylic acids. Preferred silver salts are silver salts of fatty acids having at least 12 carbon atoms, including, for example, silver laureate, silver palmitate, silver stearate, silver hydroxystearate, silver oleate, and silver behenate. Silver salts of other organic carboxylic acids described in British Patent No. 1,439,478, for example, silver benzoate is also usable as a thermally developable silver salt to form a silver image. Further, silver salts described in JP-A Nos. 10-236004, 2000-62325 and 2002-23303, European patent Nos. 962,815 and 964,300 and combinations of various silver salts of organic carboxylic acids are optimally selected to use in this invention. The organic silver salts described above can be prepared with reference to the foregoing British Patents and European Patents.

Commonly known reducing agents can be used as a reducing agents for the light-sensitive organic silver salts. Specific examples of the reducing agents include aromatic di- or tri-hydroxy compounds, aminophenol derivatives, p-phenylenediamine derivatives, alkoxynaphthol derivatives, pyrazolone-3-one derivatives, pyraziiidine-3-one derivatives, indane-1,3-dione derivatives, hydroxytetronic acid, hydroxytetronamide, hydroxylamine, derivatives, hydrazine derivatives, reductones, 1,2-dihydroxybenzene derivatives, gallic acid derivatives, and 3,4-dihydroxybenzoic acid derivatives. Of these, catechol, 3-(3,4-dihydroxyphenyl)propionic acid, 1,2-dihydroxybenzoic acid, 1,2-dihydroxybenzene derivatives described in JP-A No. 11-245510 and European Patent No. 978,760, gallic acid and its esters such as methyl gallate, ethyl gallate and propyl gallate, tannic acid, and 3,4-dihydroxybenzoic acid esters are preferred in this invention.

The combination of compounds that become a reducing agent for light-sensitive silver salts, upon heating is suitably usable in this invention, unless the object of this invention is adversely affected. Examples thereof include the combination of a reducing agent and a sulfoneamidophenol described in JP-A Nos. 56-88136 and 62-201434, the combination of a steric-hindered phenol and sulfonylhydrazide reducing agent described in JP-A No. 8-234393, and the combination of tritylhydrazide, formylphenylhydrazide and an auxiliary reducing agent described in JP-A Nos. 11-511572 and 11-511573. Acrylonitrile compounds described in JP-A Nos. 11-511571 and 2001-513211, and 2-substituted malonodialdehyde compounds are suitable usable in this invention within the range not inhibiting the object of this invention.

The image-forming layer may optionally be added with an image tone modifier, stabilizer, antifoggant and thermal solvent. The image tone modifier (or image toner) is added at a relatively high content to obtain neutral black images and at a relatively low content to obtain neutral gray images. Examples thereof include phthalimide and phthazinone derivatives described in JP-A No. 49-117026 and U.S. Pat. No. 3,074,809, 3,446,648, 3,844,797 and 4,082,901; benzoxazinedione or naphthooxazinedione derivatives described in JP-A No. 49-91215, U.S. Pat. Nos. 3,885,967, 3,951,660 and 5,599,647, and British patent No. 1,439,478. Examples of the stabilizer include —SA group-substituted unsaturated carbon cyclic or heterocyclic compounds, in which A is hydrogen, counter-ion to compensate a negative charge of the thiolate group, or a group capable of forming a symmetric or asymmetric disulfide. Examples of the antifoggant include polycarboxylic acids and/or their anhydrides, as described in JP-A Nos. 58-107534, 8-6203 and 2000-199936. These compounds are added in an amount of 0.01 to 30 mol %, and preferably 0.05 to 20 mol %, based on light-insensitive organic silver salt. The thermal solvent is optimally selected from commonly known compounds which are solid at normal temperatures and reversibly liquefied or softened upon heating.

In this invention, the image-forming layer may be comprised of a single layer or plural layers which are the same or different in composition. The image-forming layer usually has a thickness of 5.0 to 30.0 $\mu$m, and preferably 7.0 to 20.0 $\mu$m.

The protective layer may contain, in addition to the binder described earlier, optionally binders and additives used in the backing layer. Of additives to be added to the protective layer, it is preferred in the practice of this invention to incorporate a filler for the purpose of enhancing transportability and reducing the contact area with a thermal head in the image-forming process of this invention. The content of a filler is preferably 0.05 to 30 mol %, based on the composition forming the layer. The protective layer may contain a lubricant and antistatic to improve lubrication and antistatic property. Such additives are incorporated preferably at 0.01 to 20%, and more preferably 0.05 to 10% by weight, based on components forming the protective layer. In this invention, the protective layer may be comprised of a single layer or plural layers which are the same or different in composition. The protective layer usually has a thickness of 1.0 to 5.0 $\mu$m. The backing layer usually has a thickness of 0.5 to 10 $\mu$m.

In the practice of this invention, coating solutions for the backing layer, image-forming layer and protective layer can be prepared by dissolving or dispersing the foregoing components in solvents. Solvents having a solubility parameter of 15.0 to 30.0 and comprising carbon, hydrogen and oxygen atoms, which is described in "Polymer Handbook, fourth edition" 675 (John Wiley & Sons, inc., 1998), are preferably used in terms of solubility for resins and drying property in the manufacturing process. Solvents for use in coating solutions to form respective layers include, for example, ketones such as acetone (20.3), isophorone (18.6), ethyl amyl ketone (16.8), methyl ethyl ketone (19.0), methyl isobutyl ketone (17.2), cyclopentanone (21.3) and cyclohexanone (20.3); alcohols such as methyl alcohol (29.7), ethyl alcohol (26.0), n-propyl alcohol (24.3), isopropyl alcohol (23.5), n-butyl alcohol (23.3), isobutyl alcohol (21.5), t-butyl alcohol (21.7), 2-butyl alcohol (22.1), diacetone alcohol (18.8), and cyclohexanol (23.3); glycols such as ethylene glycol (29.9), diethylene glycol (24.8), triethylene glycol (21.9) and propylene glycol (25.8); ether alcohols such as ethylene glycol monomethyl ether (23.3); ethers such as diethyl ether (15.1), tetrahydrofurane (18.6), 1,3-dioxolan (17.6) and 1,4-dioxane (16.2); esters such as ethylacetate (18.6), n-butylacetate (17.4), 2-butylacetate (16.8); hydrocarbons such as n-heptane (15.1), cyclohexane (16.8), toluene (18.2) and xylene (18.0). In the foregoing, numerals in the parentheses represent a solubility parameter. Unless the object of the invention is adversely affected, solvents usable in the invention are not limited to the foregoing solvents and usable alone or in combination.

In cases when dispersing procedure is needed in the formation of coating solution, commonly known dispersing machines are optimally employed, including a two-roll mill, three-roll mil, ball mill, pebble mil, cobol mill, trone mill, sand mill, sand grinder, Sqegvari atreiter, high-speed impeller dispersant, high-speed stone mill, high-speed impact mill, disperser, high-speed mixer, homogenizer, ultrasonic dispersant, open kneader and continuous kneader.

Commonly known various coater stations are employed to coat coating solutions prepared as above on a support and examples thereof include an extrusion type extruding coater, reverse roll coater, gravure roll coater, air-doctor coater, blade coater, air-knife coater, squeeze coater, dipping coater, bar coater, transfer roll coater, kiss coater, cast coater, and spray coater. Of these coaters, an extrusion type extruding coater a roll coater such as an reverse roll coater are preferable to enhance uniformity in thickness of the layers described above. Coating the protective layer is not specifically limited unless the image forming layer is damaged, and in cases where a solvent used in a coating solution of the protective layer possibly dissolves the image forming layer, the extrusion type extruding coater gravure roll coater and bar coater can be used of the foregoing coater stations. Specifically when a contact coating system, such as a gravure roll coater and bar coater is used, the rotation direction of the gravure roll or bar may be normal or reverse with respect to the transport direction, and in the case of the normal rotation, there may be operated at a constant rate or at rates differing in circumferential speed.

As described above, coating and drying may be repeated for each layer. Alternatively, multi-layer coating may be conducted through a wet-on-wet system, in which the extrusion type extruding coater is used in combination with the foregoing reverse roll coater, gravure roll coater, air doctor coater, blade coater, air-knife coater, squeeze coater, dipping coater, bar coater, transfer roll coater, kiss coater, cast coater, spray coater or slide coater. In such multi-layer coating through a wet-on-wet system, the upper layer is coated on the lower layer in the wet state so that adhesion between the lower and upper layers is enhanced.

In the coating of an image forming layer coating solution on a support, it is preferred to subject the support surface to at least one surface treatment selected from a flame treatment, ozone treatment, glow discharge treatment, corona discharge treatment, plasma treatment vacuum ultraviolet radiation treatment, electron ray treatment and radiation ray treatment, followed by coating the image forming layer coating solution. Subjecting the support surface to such a surface treatment can strengthen adhesion between the support and image forming layer.

In this invention, the image-forming layer preferably contains a light-sensitive silver halide, thereby rendering the image forming layer light-sensitive and enabling digital writing by laser and the like.

Silver halide used in this invention is preferably comprised of silver halide grains having a relatively small average grain size to minimize cloudiness after image formation and to obtain excellent image quality The average grain size is preferably not more than 0.1 $\mu$m, and more preferably between 0.01 and 0.1 $\mu$m. The grain size as described herein is defined as a diameter of a circle having the same area as a grain observed with an electron microscope (i.e., equivalent circle diameter). Furthermore, silver halide grains are preferably monodisperse grains. The monodisperse grains as described herein refer to grains having a coefficient of variation of grain size obtained by the formula described below of not more than 40%; more preferably not more than 30%.

Degree of monodisperse (%)=(standard deviation of grain diameter/average grain diameter)×100(%)

The shape of the silver halide grains is not specifically limited, but in cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Another preferred shape of silver halide grains is a tabular grain. Herein, the tabular grain refers to grain having an aspect ratio (r/h) of 3 or more, in which "r" is a root square of the grain projected area (expressed in $\mu$m) and "h" is a thickness in the direction thereto. Specifically, the aspect ration is preferably 3 to 50. The grain thickness is preferably not more than 0.1 $\mu$m, and more preferably 0.01 to 0.08 $\mu$m. The tabular grains, which are detailed in U.S. Pat. Nos. 5,264,337, 5,314,798 and 5,320,958 can readily be prepared.

The halide composition of silver halide is not specifically limited and may be any one of silver chloride, silver chlorobromide, silver iodochlorobromide, silver bromide, silver iodobromide and silver iodide. The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964).

Silver halide used in the invention preferably occludes ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into silver halide in the form of a complex. In the invention, six-coordinate complexes represented by the general formula described below are preferred:

$$(ML_6)_m: \qquad \text{formula (5)}$$

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aqua ligand is present, one or two ligands are preferably coordinated. L may be the same or different.

In the formula (5), M is preferably copper, iron, rhodium, ruthenium, rhenium, iridium or osmium.

The foregoing metal ions, metal complexes and metal complex ions may be used alone or in combination of identical or different kinds of metals The content of the metal ion, metal complex or metal complex ion is usually $1\times10^{-9}$ to $1\times10^{-2}$ mol, and preferably $1\times10^{-8}$ to $1\times10^{-4}$ mol per mol silver halide.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-homogeneously occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method, flocculation process, ultrafiltration and electrolysis.

Silver halide grains used in the invention are preferably subjected to chemical sensitization. Preferred chemical sensitization include, for example, sulfur sensitization, selenium sensitization and tellurium sensitization. Further, noble metal sensitization using gold compound, platinum, palladium and iridium compounds, and reduction sensitization may also be employed.

Organic silver salts contained in the image forming layer relating to the invention are a reducible silver source and an organic acid salt containing a reducible silver ions. Examples of organic acids usable in the invention include aliphatic carboxylic acids, carbocyclic carboxylic acids, heterocyclic carboxylic acids and heterocyclic compounds. Specifically, long chain aliphatic carboxylic acids (having 10 to 30 carbon atoms and preferably 15 to 25 carbon atoms) and heterocyclic carboxylic acids containing heterocyclic ring are preferred. Furthermore, organic silver salt complexes, which contain a ligand having a total stability constant of 4.0 to 10.0 with respect to a silver ion, are also usable. Examples of such organic acid silver salts are described in Research Disclosure (hereinafter, also denoted as "RD") 17029 and 29963. Of these, silver salts of fatty acids are preferred and silver behenate, silver arachidate and silver stearate are specifically preferred. Silver behenate, of which corresponding fatty acid has a relatively high melting point among the foregoing three kinds of fatty acids, preferably accounts for at least 40% by weight, and more preferably at least at least 60% by weight of the silver salts.

In the invention, an average grain size of organic silver salts is preferably not more than 1 $\mu$m and monodisperse. The grain size of organic silver salts is referred to as a diameter of a sphere having the same volume as an organic silver salt grain, in cases where the organic silver salt grain is spherical, needle-like or tabular form. The average grain size is preferably 0.01 to 0.8 $\mu$m, and more preferably 0.05 to 0.5 $\mu$m. The expression, monodisperse is the same as defined in the case of silver halide, and a degree of grain dispersity (that is, a degree of homogeneity of grain size distribution) is preferably 1 to 30%. In the invention, the organic silver salt is preferably monodisperse grains having an average size of not more than 1, thereby leading to higher image density. At least 60% of the organic silver salt is preferably accounted for by tabular grains. The tabular grains of the organic silver salt is the same as defined in silver halide described earlier and refers to those which have an aspect ratio of 3 or more.

Organic silver salt grains used in the invention are preliminarily dispersed together with a binder or surfactant and then pulverized using a media dispersing machine or high-pressure homogenizer. In the preliminary dispersion can be used an anchor-type or propeller-type stirrer commonly known, a high-speed rotating centrifugal stirrer (dissolver), and a high-speed rotating shearing-type stirrer (homomixer). As the foregoing media dispersing machine, a convolution mill such as ball mill, planet mill and vibration mill, beads mill as a medium-stirring mill. atreiter and basket mill can be used and as a high-pressure homogenizer, various types thereof can be used, including a type of colliding with wall or plug, a type of dividing liquid into plurality, followed by colliding with each other at a high-speed and a type of allowing to pass through a fine orifice. Further, ceramics such as zirconia, alumina and silicon nitride or diamond are optimally used as media for the dispersion.

As reducing agents contained in the image-forming layer of the invention, commonly known compounds are employed, including, for example, phenols, polyphenols having two or more hydroxy groups, naphthols, bisnaphthols, polyhydroxybenzenes having two or more hydroxy groups, ascorbic acids, 3-pyrazolidones, pyrazoline-5-ones, pyrazolines, phenylenediamines, hydroxyamines, hydroquinone monoethers, hydroxamic acids, hydrazides, amidoximes and N-hydroxyureas. Of the foregoing reducing agents, preferred reducing agents used together with aliphatic carboxylic acid silver salts as an organic silver salt include, for example, polyphenols in which two or more phenols are linked with an alkylene linkage group or sulfur, specifically polyphenols, in which two or more phenol moieties are substituted, at least one position adjacent to the phenolic hydroxy group, by an alkyl group (e.g., methyl, ethyl, propyl, t-butyl, cyclohexyl) or an acyl group (e.g., acetyl, propionyl) and linked with an alkylene group or sulfur, such as 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, (2-hydroxy-3-t-butyl-5-methylphenyl)-(2-hydroxy-5-methylphenyl)methane, 6,6'-benzilidene-bis(2,4-di-t-butylphenol), 6,6-benzilidene-bis(2-t-butyl-4-methylphenol), 6,6'-benzilidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, and 2,2-bis(4-hydroxy-3,5-di-t-butylphenyl)propane, as described in U.S. Pat. Nos. 3,589,903 and 4,021,249; British Patent No. 1,486,148; JP-A 51-51933, 50-36110, 50-116023, 52-84727, 2001-56527, and 2001-92075; JP-B No. 51-35727 (hereinafter, the term, JP-B means published Japanese Patent); bisnaphthols described in U.S. Pat. No. 3,672,904, such as 2,2'-dihydoxy-1,1'-binaphthyl, 6,6'dibromo2,2'-dihydroxy-1,1'-binaphthyl, 6,6'-dinitro-2,2'-dihydroxy-11'-binaphthyl, bis(2-hydroxy-1-naphthyl)methane, 4,4'-dimethoxy-1,1'-dihydroxy-2,2'binaphthyl; sulfonamidophenols or sulfonamidonaphthols described in U.S. Pat. No. 3,801,321, such as 4-benzenesulfonamidophenol, 2-benzenesulfonamidophenol, 2,6-dichloro4-benzenesulfonamidophenol and 4-benzenesulfonamidonaphthol.

A content of the reducing agent in the image forming layer, is variable, depending of the kind of an organic silver salt or reducing agent and other constituents, and usually 0.05 to 10 mol, and preferably 0.1 to 3 mol per mol of organic silver salt. The foregoing reducing agents may be used in combination within the range of contents described above.

In the practice of this invention, the image-forming layer may further be added with a silver-saving agent, sensitizing dyes and material exhibiting supersensitization (hereinafter, such material is called supersensitizer). The silver saving agent refers to a compound capable of reducing a silver amount necessary to obtain a given density. Various mechanisms of action for the reduction are supposed and a compound having a function of enhancing the covering power of developed silver is preferred, in which the covering power refers to a density per unit weight of silver.

Examples of such a silver-saving agent include hydrazine compounds and vinyl compounds described in U.S. Pat. Nos. 5,496,695, 5,545,505, 5,545,507, 5,637,449, 5,654,130, 5,635,339, 5,545,515, 5,686,228; JP-A Nos. 10-339929, 11-84576, 11-95365, 11-95366, 11-109546, 11-119372, 11-119373, 2000-356834, 2001-27790, and 2001-174947. Furthermore, an alkoxysilane compound containing at least two primary or secondary amino groups and its salt, and/or a schiff base formed from a dehydrating condensation reaction between an alkoxysilane compound containing at least one primary amino group and a ketone compound are also suitably usable as a silver-saving agent. The expression, having at least two primary or secondary amino groups refers to having at least two primary amino groups, having at least two secondary amino groups, or having at least one primary amino group and at least one secondary amino group and "its salt", i.e., salt of the alkoxysilane compound refers to an adduct of the alkoxy silane compound and an inorganic acid or organic acid capable of forming an onium salt together with the amino group.

Examples of such alkoxy-silane compound or a salt thereof are shown below but are not limited to these, including any alkoxy-silane compound having at least two primary or secondary amino groups or salt thereof.

C-1

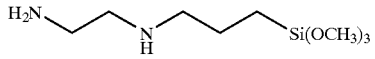

C-2

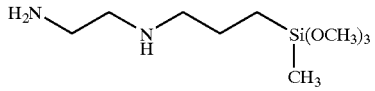

C-3

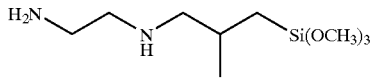

C-4

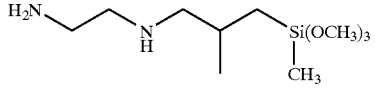

C-5

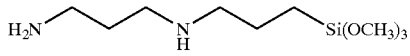

C-6

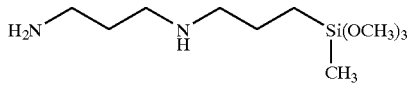

C-7

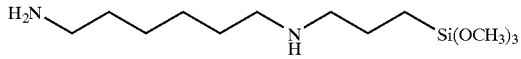

C-8

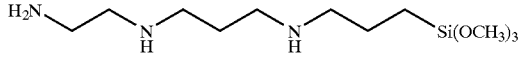

C-9

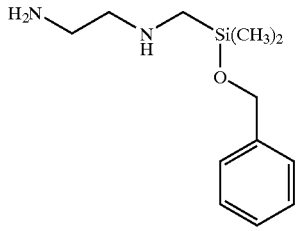

C-10

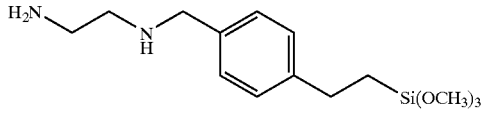

C-11

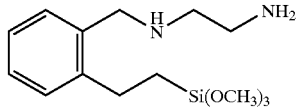

C-12

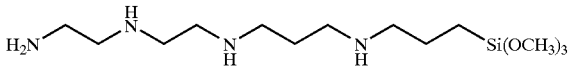

C-13

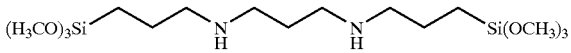

-continued
C-14
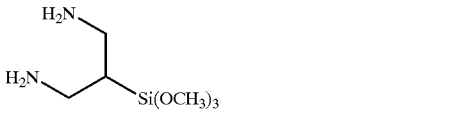
C-15
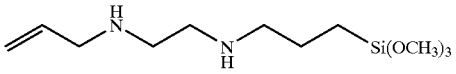
C-16
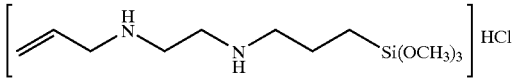
C-17
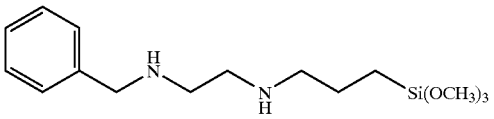
C-18
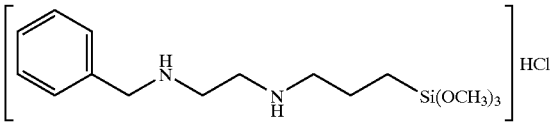
C-19
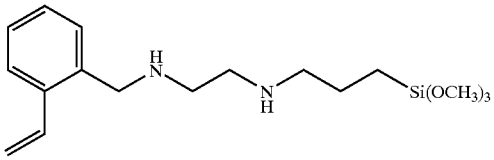
C-20
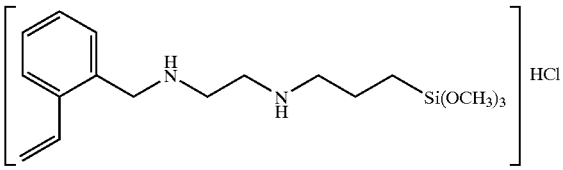
C-21
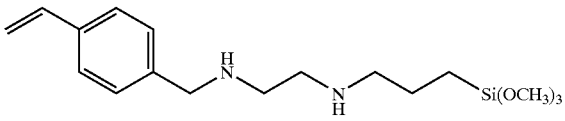
C-22
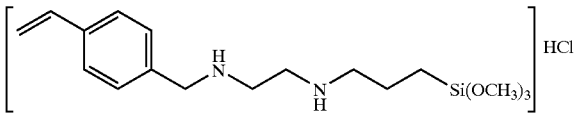
C-23
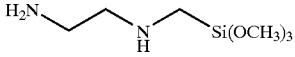
C-24
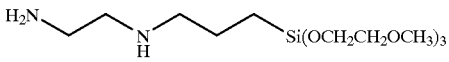
C-25
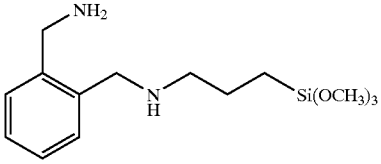
-continued
C-26
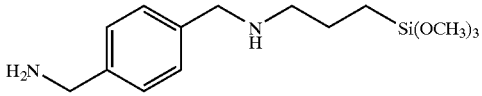
C-27
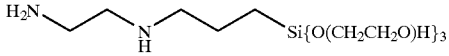
C-28
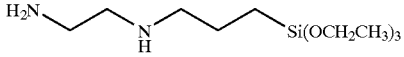
C-29
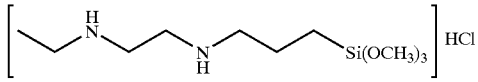
C-30
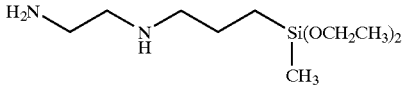
C-31
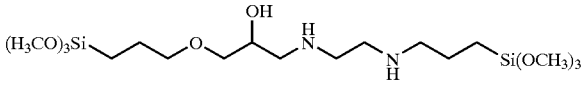
C-32
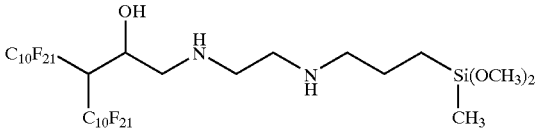
C-33
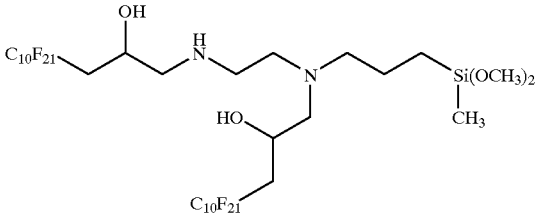
C-34
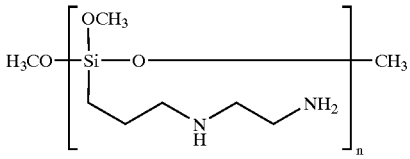
C-35
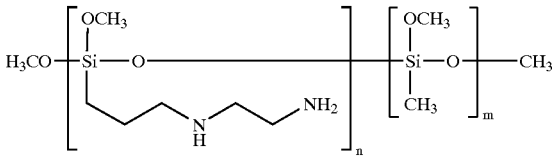
C-36
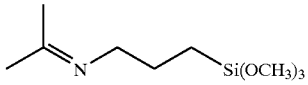
C-37
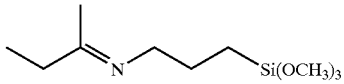

-continued
C-38
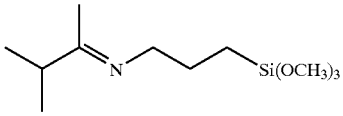
C-39
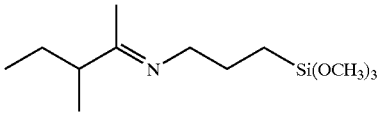
C-40
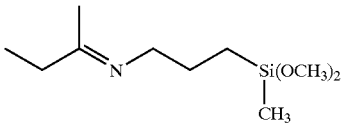
C-41
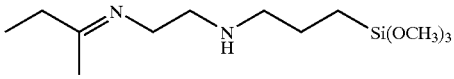
C-42
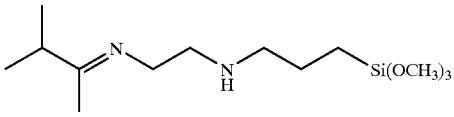
C-43
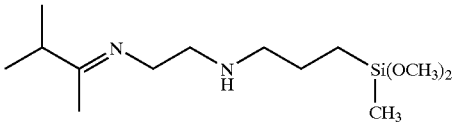
C-44
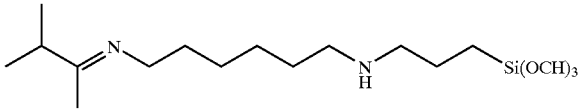
C-45
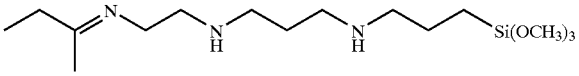
C-46
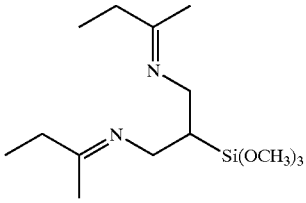
C-47
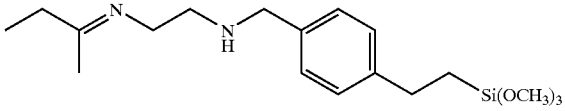
C-48
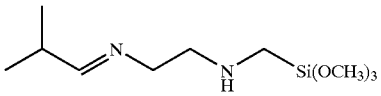
-continued
C-49
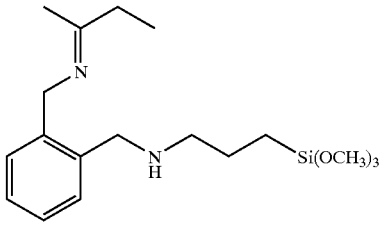
C-50
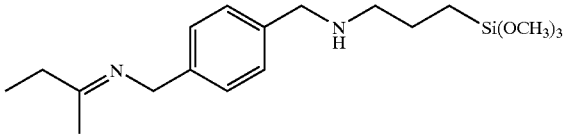
C-51
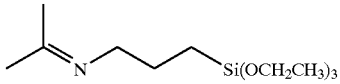
C-52
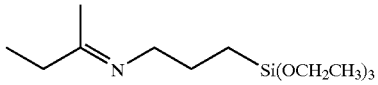
C-53
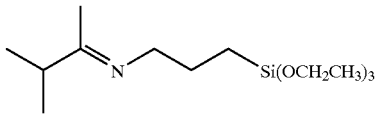
C-54
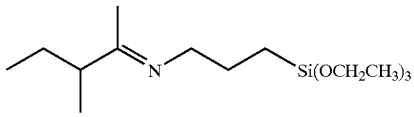
C-55
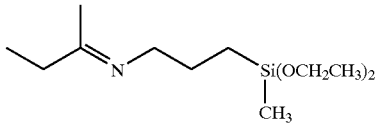
C-56
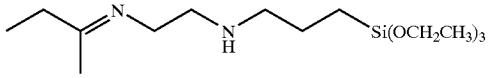
C-57
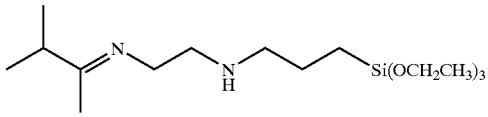
C-58
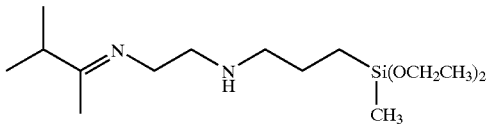
C-59
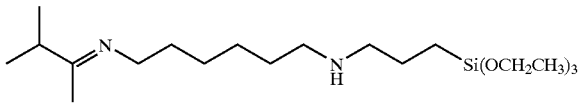

-continued

C-60

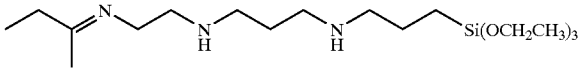

As an antifoggant to improve raw stock stability and image lasting quality, a halogen compound represented by the following formula (6) is preferred:

formula (6)

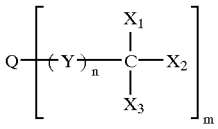

wherein $X_1$, $X_2$ and $X_3$ are each a hydrogen atom, halogen atom, acyl group, alkoxycarbonyl group, aryloxycarbonyl group, sulfonyl group, and aryl group, provided that at one of $X_1$, $X_2$ and $X_3$ is a halogen atom; Y is —NR—C(=O)—, —C(=O)—, —Z—C(=O)—, —Z—S(=O)—, —SO— or —$SO_2$—, in which R is a hydrogen atom or an alkyl group, provided that R may link with Q described below to form a ring, and Z is an oxygen or sulfur atom; n is an integer of 0 to 2, and m is an integer of 1 to 10; and Q is an alkyl group, aryl group or heterocyclic group, which may be substituted.

The alkyl group represented by Q in the formula (6) is a straight chain, branched or cyclic alkyl group, preferably having 1 to 30 carbon atoms, and more preferably 1 to 20 carbon atoms. The alkyl group represented by Q may be substituted and any substituent giving no adverse effect in the process of micro-capsulation can be used. Examples of such a substituent include a halogen atom, alkenyl group, alkynyl group, aryl group, heterocyclic group (including a N-substituted nitrogen-containing heterocyclic group, such as morpholine group), alkoxycarbonyl group, aryloxycarbonyl group, carbamoyl group, imino group, N-substituted imino group, carbazoyl group, cyano group, thiocarbamoyl group, aryloxy group, heterocyclic-oxy group, acyloxy group, (alkoxy- or aryloxy-)carbonyloxy group, sulfonyloxy group, acylamido group, sulfonamido group, ureido group, thioureido group, imido group, (alkoxy- or aryloxy-) carbonylamino group, sulfamoylamino group, semicarbazide group, thiosemicarbazide group, (alkyl- or aryl-) sulfonylureido group, nitro group, (alkyl- or aryl-)sulfonyl group, sulfamoyl group, group having a phosphoric acid amide or phosphoric acid ester structure, and silyl group. These substituents may further be substituted.

The aryl group represented by Q may be a single ring or condensed ring aryl group, preferably having 6 to 24 carbon atoms, and more preferably 6 to 20 carbon atoms. Examples thereof include phenyl, naphthyl, anthracenyl, naphthacenyl and triphenylenyl. The aryl group represented by Q may be substituted and any substituent giving no adverse effect in the process of micro-capsulation can be used. Examples of such a substituent include a halogen atom, alkenyl group, alkynyl group, aryl group, heterocyclic group (including a N-substituted nitrogen-containing heterocyclic group, such as morpholine group), alkoxycarbonyl group, aryloxycarbonyl group, carbamoyl group, imino group, N-substituted imino group, carbazoyl group, cyano group, thiocarbamoyl group, aryloxy group, heterocyclic-oxy group, acyloxy group, (alkoxy- or aryloxy-)carbonyloxy group, sulfonyloxy group, acylamido group, sulfonamido group, ureido group, thioureido group, imido group, (alkoxy- or aryloxy-) carbonylamino group, sulfamoylamino group, semicarbazide group, thiosemicarbazide group, (alkyl- or aryl-) sulfonylureido group, nitro group, (alkyl- or aryl-)sulfonyl group, sulfamoyl group, group having a phosphoric acid amide or phosphoric acid ester structure, and silyl group. These substituents may further be substituted.

The heterocyclic group represented by Q in the formula (6) a 4- to 8-membered, saturated or unsaturated heterocyclic group containing at least one atom of nitrogen, oxygen, sulfur, selenium and tellurium, which may be a single ring or a ring condensed with other rings. Examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene. The heterocyclic group represented by Q may be substituted and any substituent giving no adverse effect in the process of micro-capsulation can be used, as described above.

Examples of the halogen compound represented by formula (6) are shown below.

P-1

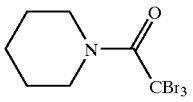

P-2

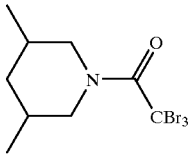

P-3

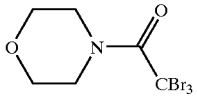

P-4

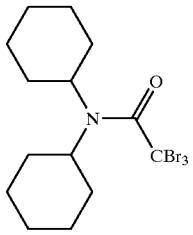

-continued
P-5
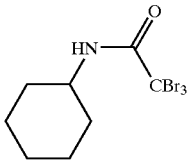
P-6
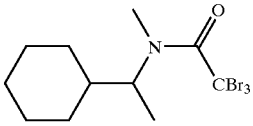
P-7
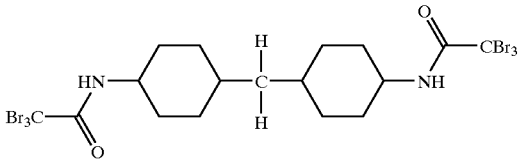
P-8
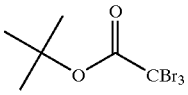
P-9
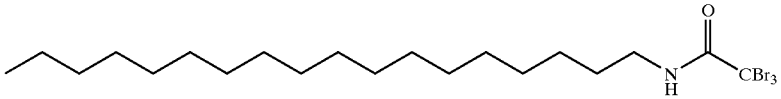
P-10
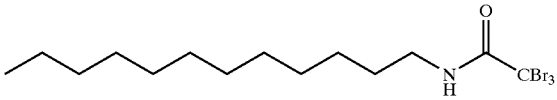
P-11
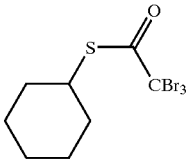
P-12
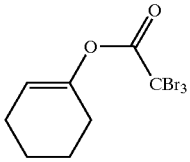
P-13
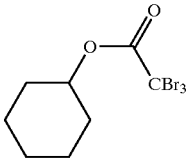
P-14
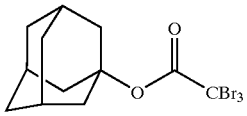
P-15
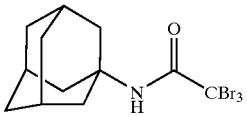
P-16
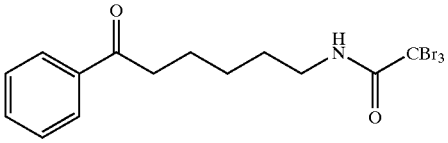
P-17
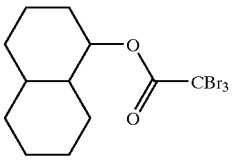
P-18
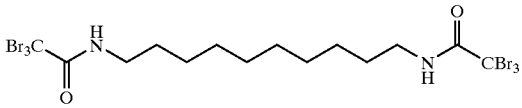
P-19
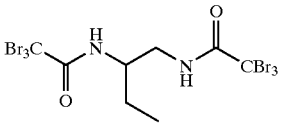
P-20
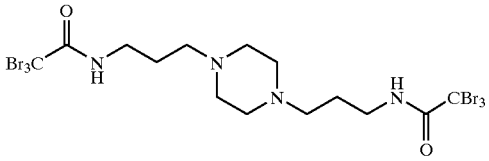
P-21
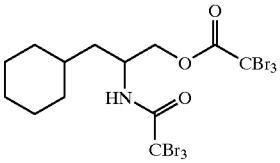
P-22
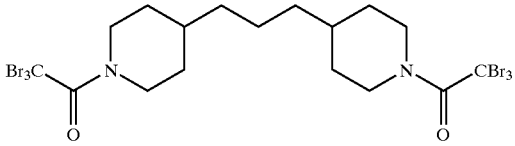
P-23
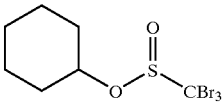

-continued
P-24
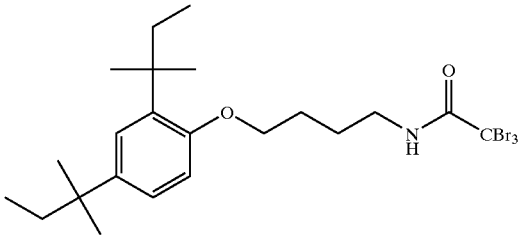
P-25
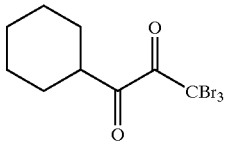
P-26
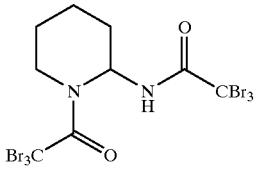
P-27
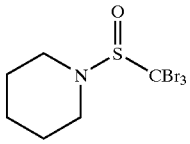
P-28
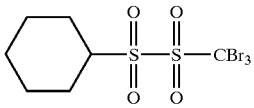
P-29
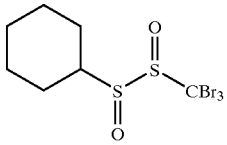
P-30
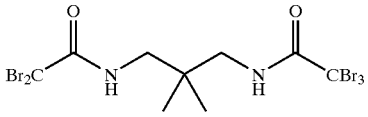
P-31
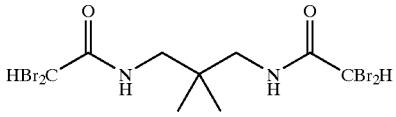
P-32
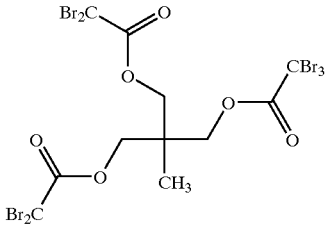
P-33
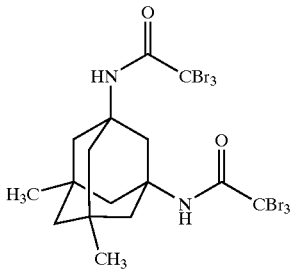
P-34
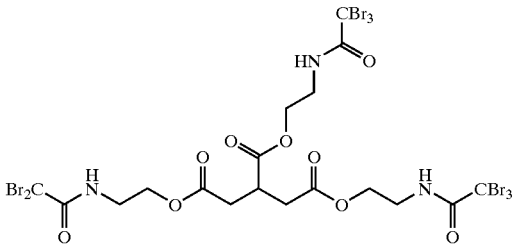
P-35
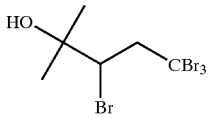
P-36
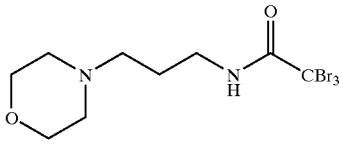
P-37
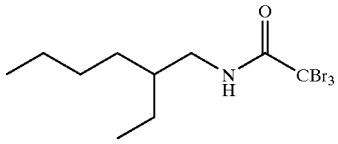
P-38
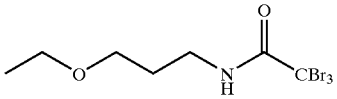
P-39
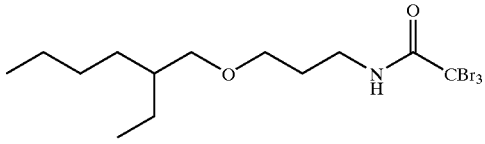

-continued
P-40
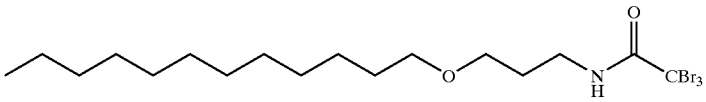
P-41
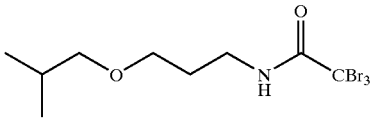
P-42
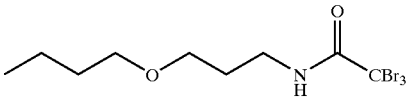
P-43
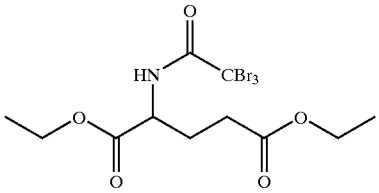
P-44
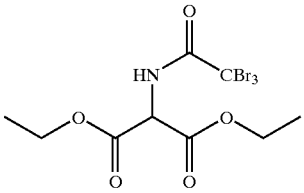
P-45
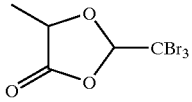
P-46
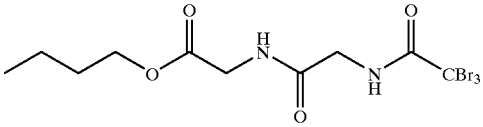
P-47
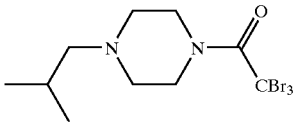
P-48
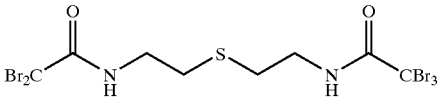
P-49
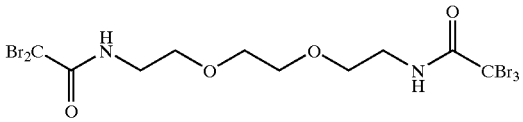
P-50
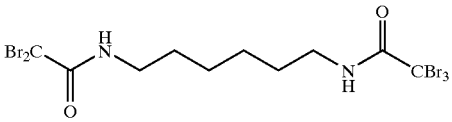
P-51
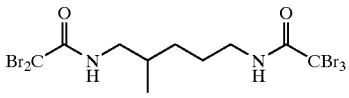
P-52
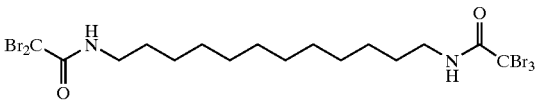
P-53
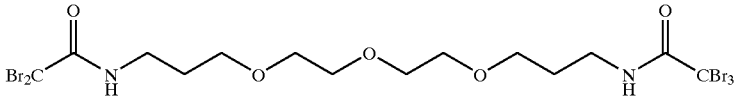
P-54
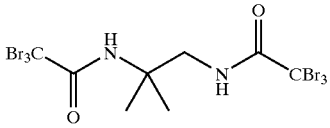
P-55
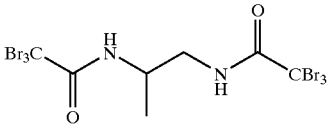
P-56
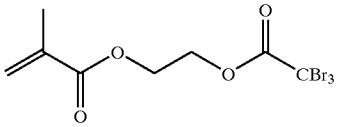
P-57
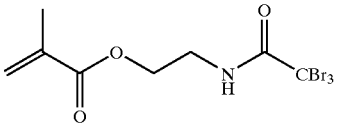
P-58
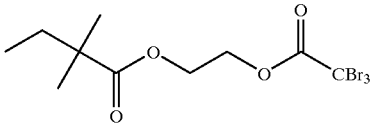
P-59
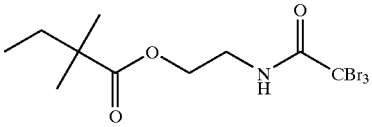

-continued
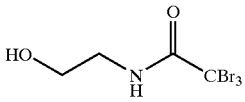
P-60
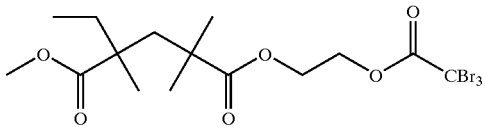
P-61
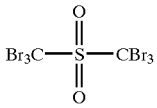
P-62
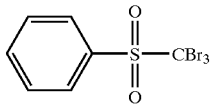
P-63
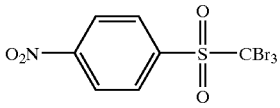
P-64
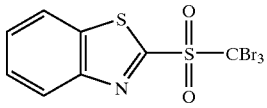
P-65
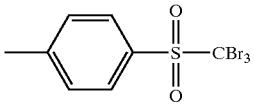
P-66
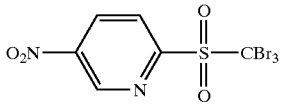
P-67
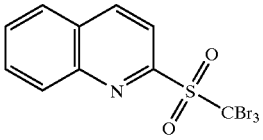
P-68
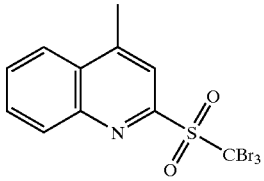
P-69
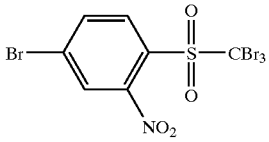
P-70
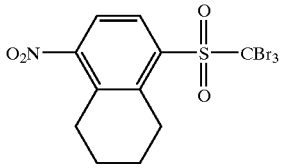
P-71
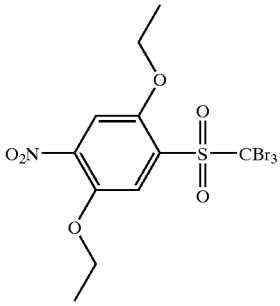
P-72
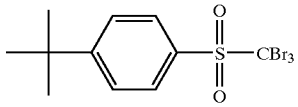
P-73
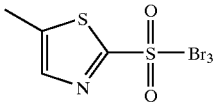
P-74
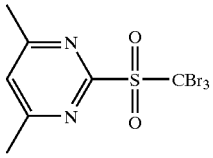
P-75
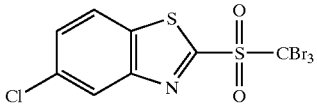
P-76
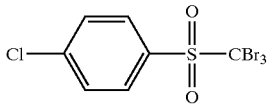
P-77
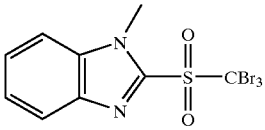
P-78
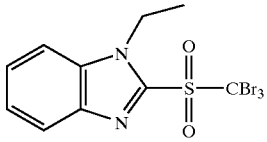
P-79

-continued
P-80
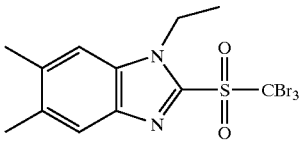
P-81
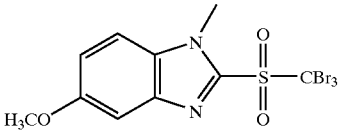
P-82
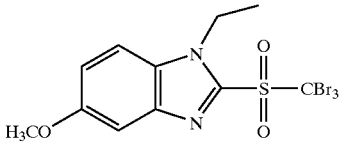
P-83
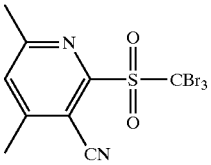
P-84
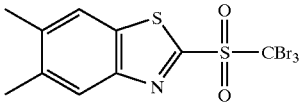
P-85
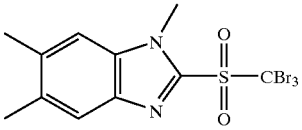
P-86
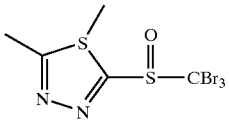
P-87
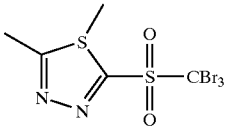
P-88
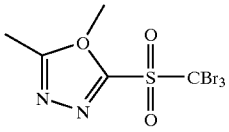
P-89
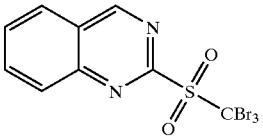
P-90
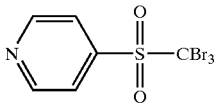
P-91
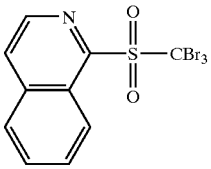
P-92
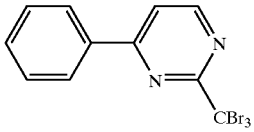
P-93
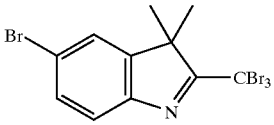
P-94
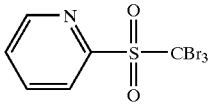
P-95
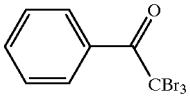
P-96
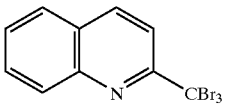
P-97
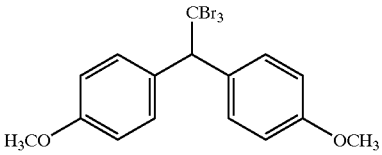
P-98
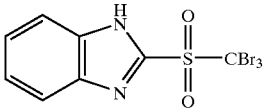
There are also usable, within the range not inhibiting the object of this invention, compounds described in U.S. Pat. Nos. 3,874,946, 4,756,999, 5,028,523, 5,340,712, 5,369,000, 5,464,737; European Patent Nos. 600,587, 605,981, 631,176; JP-B Nos. Nos. 54-44212, 51-9694 (hereinafter, the term, JP-B refers to Japanese Patent Publication); JP-A Nos. 50-137126, 50-89020, 50-119624, 55-140833, 59-57234, 7-2781, 7-5621, 9-90550, 9-160164, 9-160167, 9-244177, 9-244178, 9-258367, 9-265150, 9-288328, 9-319022, 10-197988, 10-197989, 11-242304, 2000-2963, 2000-112070, 2000-284412, 2000-284410, and 2001-33911, which may used singly or in combination.

In addition to the foregoing halogen compounds, polycarboxylic acid and its anhydride described in JP-A Nos. 58-107534, 8-6203, 2000-199936, 2000-321711, 2002-23304 and 2002-49121; thiosulfonic acid and its salt or derivatives described in 51-78227, 53-20923, 550140833, 7-209797, 8-1059, 9-43760, 2000-284400, 2000-284413; carboxylic acid, sulfonic acid or their salts described in U.S. Pat. No. 6,083,681, JP-A No. 2002-62616, 2002-62617, and 2002-90935.

Image tone modifiers may be used to modify silver image tone. Examples thereof include imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1, 8-naphthalimide); cobalt complexes (for example, cobalt hexaminetrifluoroacetate), mercaptans (for example, 3-mercapto-1,2,4-triazole); N-(aminomethyl)aryldicarboxyimides (for example, N-(dimethylaminomethyl) phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane) bis-(isothiuroniumtrifluoroacetate), and 2-(tribromomethylsulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1, 4-diphenyl-1H,4H-2,3a,5,6a-tatraazapentalene). Preferred tone modifiers include phthalazone or phthalazine. The image tone modifier may be incorporated into a protective layer, without adversely affecting the object of the invention.

There is usable in this invention any sensitizing dye for silver halide which has an absorption within the region of oscillating wavelengths of laser light source used in the scanning exposure of the image-forming process, as described later. Of laser light sources, semiconductor lasers at wavelengths of 700 to 1200 nm are preferred in terms of maintenance and size of the light source. Examples of a sensitizing dye having an absorption maximum within such a wavelength region include cyanine dyes, rhodacyanine dyes, oxonol dyes, carbocyanine dyes, dicarbocyanine dyes, tricarbocyanine dyes, tetracarbocyanine dyes, pentacarbocyanine dyes, styryl dyes, pirilium dyes, and metal containing dyes such as metal phthalocyanine and metal porphyrin. Specifically, dyes described in Chem. Rev.92, 1197 (1992), and dyes described in JP-A Nos. 48-3527, 49-11121, 58-145936, 59-191932, 59-192242, 60-80841, 62-284343, 2-105135, 3-670841, 62-284343, 2-105135, 3-67242, 3-163440, 4-182639, 5-341432, 7-13295, 11-30833, 11-352628, 2000-95958, 2000-98524, 2000-122207, 2000-169741, 2000-171938, 2000-273329, 2000-321704, 2001-64527, 2001-83655 and 9-510022.

Compounds described in RD17643, IV-J at page 23, JP-B 9-25500 and 43-4933 (herein, the term, JP-B means published Japanese Patent) and JP-A 59-19032, 59-192242 and 5-341432 can be used as a supersensitizer. In this invention, an aromatic heterocyclic mercapto compound represented by the following formula (7) and disulfide compound which is capable of forming the mercapto compound represented by the following formula (8) are preferred as a supersensitizer:

Ar—SM formula (7)

Ar—S—S—Ar Formula (7a)

wherein M is a hydrogen atom or an alkali metal atom; Ar is an aromatic ring or condensed aromatic ring containing a nitrogen atom, oxygen atom, sulfur atom, selenium atom or tellurium atom. Preferred aromatic heterocycles include benzimidazole, naphthoimidazole, benzthiazole, naphthothiazole, benzoxazole, naphthoxazole, benzoselenazole, benzotellurazole, imidazole, oxazole, pyrazolo, triazole, triazine, pyrimidine, pyrazine, pyridine, purine, quinoline and quinazolone. The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Thiuronium compounds shown below are also a preferred supersensitizer to achieve enhanced sensitivity.

T-1

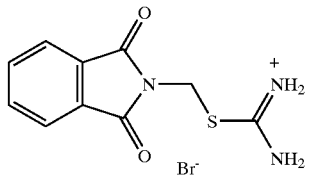

T-2

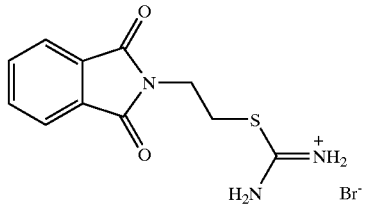

T-3

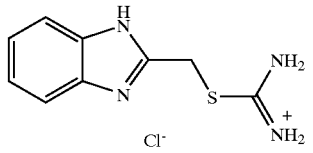

-continued
T-4
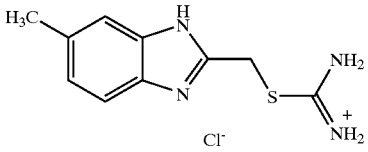
T-5
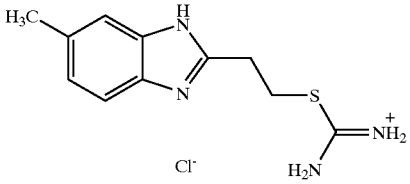
T-6
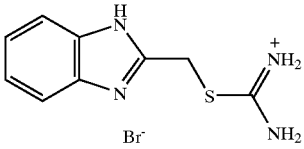
T-7
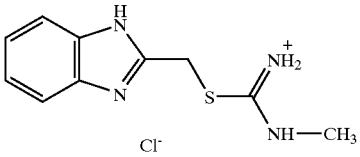
T-8
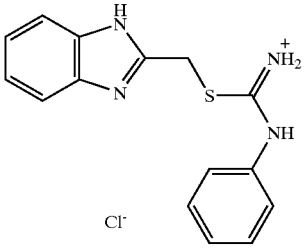
T-9
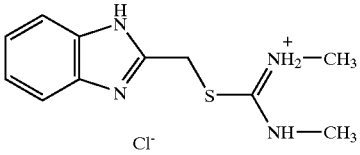
T-10
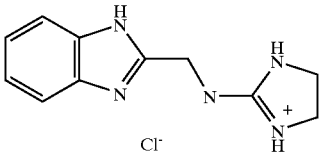
T-11
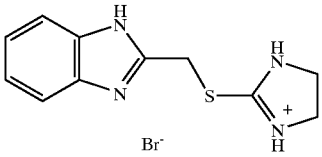
T-12
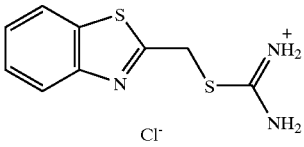
-continued
T-13
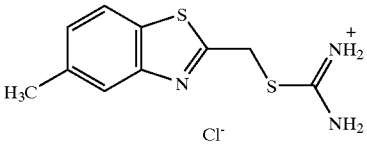
T-14
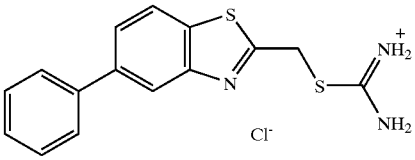
T-15
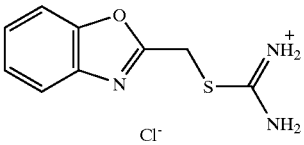
T-16
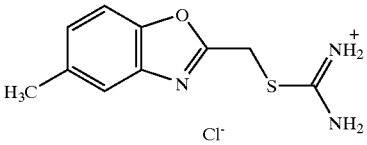
T-17
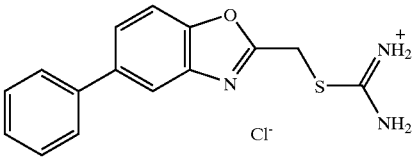
T-18
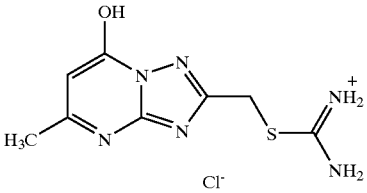
T-19
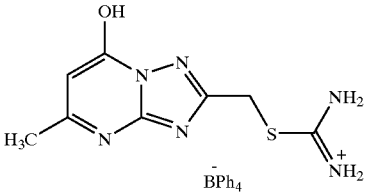
T-20
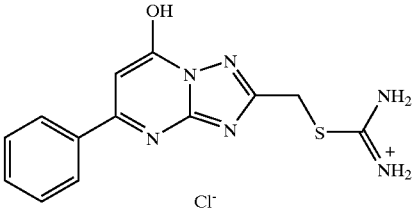

-continued

T-21

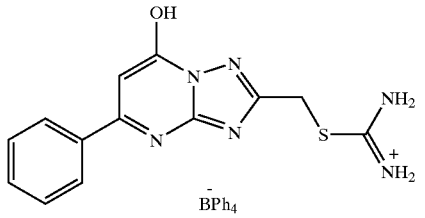

T-22

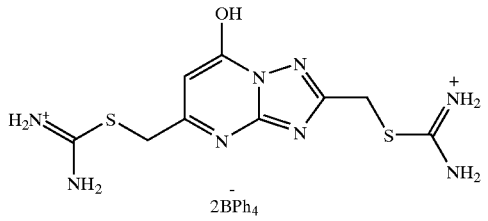

T-23

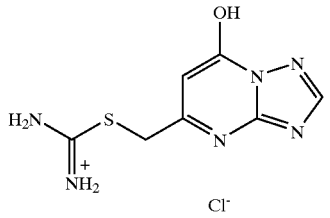

Thiuronium compounds described in JP-A No. 2001-330918 are also usable within the object of this invention.

The foregoing supersensitizers are incorporated in the image forming layer containing an organic silver salt and silver halide grains, preferably in an amount of 0.001 to 1.0 mol, and more preferably 0.01 to 0.5 mol per mol of silver.

A macrocyclic compound containing a heteroatom may be incorporated in the image forming layer. Thus, macrocyclic compounds comprising a 9- or more membered ring (more preferably 12- to 24-membered ring, and still more preferably 15-to 21-membered ring), containing at least one heteroatom selected from nitrogen, oxygen, sulfur and selenium are preferable. Representative compounds thereof include so-called crown ether compounds, which were synthesized for the first time by Pederson in 1967, and many of which were synthesized since then. These compounds are detailed in C. J. Pederson, Journal of American Chemical Society, vol. 86 (2495), 7017–7036 (1967); G. W. Gokel, S. H. Korzeniowski "Maclocyclic Polyether Synthesis", Springer-Vergal, (1982).

In addition to the foregoing additives may be incorporated a surfactant, antioxidant, stabilizer, plasticizer, UV absorber and coating aid. These additives are optionally selected from compounds described in RD Item 17029 (June, 1978, page 9–15).

Next, an image-forming process using the image-forming material according to this invention will be described.

In one embodiment of the image forming process relating to this invention, the image forming material according to this invention is imagewise heated from the protective layer side to form a silver image. In this image forming process, lasers in the region of near-infrared through infrared and a thermal head are usually used as a means for imagewise heating and the use of a thermal head is preferred in terms of compactness and maintenance of a device. Thermal heads have been widely employed in a melt transfer system such as a label printer, color thermography using thermographic paper and sublimation transfer systems such as dye transfer. Serial-type and line-type thermal heads are applicable to the image-forming process relating to this invention and the line-type one, in which heating elements are arranged so as to cover the entire transverse direction of an image-forming material is preferred. Examples of the line-type thermal head include heating elements lined up in the scanning direction; heat-staggered generators described in JP-A Nos. 6-91912, 8-258305, 9-193438 and 2000-198229; double-line generators described in JP-A Nos. 10-315518 and 2001-180026; and an arrangement including preliminary heating. Individual heating elements may be in any form, such as a conventional rectangular form, trapezoidal form or wedge-wise stepped form described in JP-A No. 7-76117. The surface temperature distribution on the surface of a single heating element when pulses may be entirely uniform or one in which the central portion is heated at a relatively high temperature, as described in JP-A Nos. 60-58877 and 61-230959.

The grazing form of a thermal head may be entire graze, partial graze or other commonly known forms. The recording density of a heating element, depending on the inputted image is usually 150 to 600 dot/inch, and preferably 200 to 400 dot/inch. The intended gradation of an image can be achieved by obtaining necessary tonal steps of the image by varying cycle, application time, applied voltage, duty-cycle and the like of inputted pulses. The surface temperature of a thermal head usually falls within the range of 300 to 400° C. when applying energy and the pressure applied between a platen roll and a thermal head (or platen pressure) is preferably 1 to 6 $N/cm^2$ to achieve uniform heat-transfer.

In another embodiment of the image-forming process relating to this invention, the image forming material according to this invention is imagewise exposed to light from the protective layer side and subsequently overall heated (hereinafter, also denoted as thermal development) to form a silver image. In this case, the image-forming material contains light-sensitive silver halide, rendering the image-forming layer light-sensitive and thereby permitting digital exposure and writing-in by a laser.

To perform imagewise exposure, lasers which are capable of performing scanning exposure are preferably used as a light source. Lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 700 to 1200 nm are preferred in terms of maintenance and the size of the light source.

When the photothermographic material is scanned with laser light using an laser imager or laser image setter, the beam spot diameter on the surface of the photosensitive material is generally within the range of 5 to 75 $\mu$m with respect to minor axis and 5 to 100 $\mu$m with respect to major axis. The laser light scanning speed can be optimally set for respective photothermographic materials in accordance with sensitivity of the photothermographic material at the laser oscillating wavelength and a laser power.

In the foregoing laser scanning exposure, an angle between laser light and the surface exposed to the light, laser wavelength and number of lasers are adjusted. These may be conducted alone or in combination thereof, whereby clear images can be obtained without producing any interference fringe.

In the first embodiment of the image-recording process relating to this invention, exposure is conducted by the use of laser scanning exposure, in which scanning laser light is not exposed at an angle substantially vertical to the photothermographic material surface exposed to the laser. The expression "laser light is not exposed at an angle substantially vertical to the exposed surface" means that laser light is not exposed at 90° in the main scanning direction and sub-scanning direction, preferably at an angle of 55 to 88°, and more preferably 60 to 86°.

In the second preferred embodiment, the image-recording process is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the image-recording process, it is preferred to form images by scanning exposure using at least two laser beams. The image recording method using such plural laser beams is a technique used in image-writing means of laser printers or digital copying machines for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and using a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is commonly represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beams preferably meets the following requirement:

$$0.9\times E \leqq En\times N \leqq 1.1\times E$$

in which E is the exposure energy of a laser beam of a wavelength of λ nm on the exposed surface when a single laser beam is exposed, and N laser beams each are assumed to have an identical wavelength and identical exposure energy (En). Thereby, the exposure energy on the exposed surface can be obtained and reflection of each laser light onto the image forming layer is reduced, minimizing occurrence of an interference fringe.

In the foregoing, plural lasers at a wavelength of λ, but plural lasers differing in wavelength may be used. In this case, the wavelengths are preferably within the region of $(\lambda-30)<\lambda_1, \lambda_2, \ldots \lambda_n \leqq (\lambda+30)$.

In the image-forming process, thermal development is conducted by heating or heating with applying pressure, using a means for thermal development, such as an oven, heated roll, pressure heated roll, hot stamper and heated block. In cases when using a thermal roll processor of heat source-contacting transport type, the roll surface temperature is 120 to 140° C., and preferably 125 to 130° C.; the contact time is 10 to 30 sec., and preferably 10 to 20 sec.; and the line pressure is usually 0 to 50 N/cm, and preferably 0 to 10 N/cm. In the case of a thermal block processor of a heat source-noncontacting transport type, the temperature near the image-forming material is usually 110 to 140° C., and preferably 120 to 130° C.; and the time is usually 10 to 180 sec., and preferably 15 to 120 sec.

EXAMPLES

The present invention will be further described in detail based on examples, but the invention is by no means limited to these. In the following description, water means deionized water, "%" is represented by percentage by weight, unless specifically noted. In addition to the resins relating to this invention, resins shown below were also used in Example.

B-19: Cellulose acetate propionate (CAP482-20, Eastman Chemical Co.)

B-20: Cellulose acetate butyrate (CAB-171-15, Eastman Chemical Co.)

B-21: Cellulose acetate (CA-398-6, Eastman Chemical Co.)

B-22: Polyvinyl butyral resin (S-lec BL-5Z, Sekisui Chemical Co., Ltd.)

B-23: Polyvinyl butyral resin (Butvar B-79, SOLCIA)

B-24: Polyvinyl acetoacetal (S-lec KS-1, Sekisui Chemical Co., Ltd.)

Example 1

Preparation of Image Forming Material

Preparation of Backing Layer Coating Solution

A coating solution to form a backing layer was prepared in the following manner.

To 83 g of methyl ethyl ketone (also designated as MEK), 8.42 g of cellulose acetate propionate (CAP482-20, available from Eastman Chemical Co.) and 0.45 g of polyester resin (Vitel PE2200B, available from Bostic Corp.) were added with stirring and dissolved therein. To the resulting solution was added 1.03 g of infrared dye 1, then, 4.5 g fluorinated surfactant [Surflon S-381 (active ingredients of 70%) available from ASAHI Glass Co. Ltd.] and 0.23 g fluorinated surfactant (Megafac F120K, available from DAINIPPON INK Co. Ltd.) which were dissolved in 4.32 g methanol, were added thereto and stirred until being dissolved. Then, 7.5 g of silica (Siloid 64×6000, available from W. R. Grace Corp.), which was dispersed in methyl ethyl ketone in a concentration of 1 wt % using a dissolver type homogenizer, was added and then 1.78 g of isocyanate compound (Coronate C-3041, available from Nippon Polyurethane Ind. Co., Ltd.) was further added thereto with stirring to obtain a coating solution for the backing layer.

Backing Layer Coating

One side of a blue-tinted, 175 μm thick, biaxially stretched polyethylene terephthalate film, which was tinted so as to have a blue density of 0.1 (which was determined to decimal three significant figures using densitometer PDA-65, available from Konica Corp.) using a blue dye (Ceres Blue RR-J, available from Bayer Co.), was subjected to a plasma treatment in an atmosphere of argon, nitrogen and hydrogen in a volume ratio of 90%, 5% and 5%, respectively, using a batch type atmospheric plasma treatment apparatus (AP-1-H-340, available from E. C. Chemicals Co.) at a high frequency output of 4.5 kW and a frequency of 5 kHz for 5 sec. The other side of the film was also subjected to a corona discharge treatment (at 40 $W/m^2 \cdot min$). The thus prepared coating solutions was coated on the side that was subjected to the corona discharge treatment, using an extrusion coater and dries so as to form a dry layer of 3.5 μm.

Preparation of Image Forming Layer Coating Solution

Preparation of Powdery Organic Silver Salt A

In 4720 ml water were dissolved 266.2 g of behenic acid at 80° C. Then, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added 780.0 ml of 1M aqueous silver nitrate solution, while maintained at a temperature of 55° C., then, the reaction mixture was further stirred for 20 min. and filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain powdery organic silver salt A.

Preparation of Light-insensitive Organic Silver Salt Dispersion

In 291.4 g methyl ethyl ketone was dissolved 2.91 g of poly(vinyl butyral) resin (S-lec BL-5Z, hydroxyl value of 175, available from Sekisui Chemical Co., Ltd.) and further thereto was gradually added 100 g of the powdery organic silver salt A with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain light-sensitive emulsified dispersion.

Preparation of Image Forming Layer Coating Solution

The foregoing light-insensitive organic silver salt dispersion of 50 g and 10.0 g of methyl ethyl ketone were mixed and maintained at 20° C., and 12.68 g of poly(vinyl butyral) resin (S-lec BL-5Z, hydroxyl value of 175, available from Sekisui Chemical Co., Ltd.) was added thereto, then, 2.63 g of ethyl 3,4-hydroxybenzoate, 0.71 g of benzo[e][1,3]oxazine-2,4-dione, 0.36 g of 7-(ethylcarbonato)benzo[e][1,3]oxazine-2,4-dione, 0.41 g of tetrachlorophthalic acid anhydride and 0.93 g of adipic acid were successively added, and stirred for 30 min. to obtain image forming layer coating solution 1.

Preparation of Protective Layer Coating Solution

In a solvent described in Table 1 was dissolved with stirring 20.0 g of resin described in Table 1, and then, 0.50 g of a UV absorber (UBINAL 3035,available from BASF Co.), 0.10 g of a fluorinated surfactant (Surflon KH40 available from ASAHI Glass Co. Ltd.), a 20% solid silicone resin methyl ethyl ketone solution (Symac US352, available from Toa Gosei Co. Ltd.) and polyisocyanate compound (50% solid, Coronate C-3041, available from Nippon Polyurethane Ind. Co., Ltd.) in an amount described in Table 1 were successively added and dissolved to prepare a protective layer resin solution 1. Separately, 5.0 g of silicone resin particles (Tospar 130, available from GE Toshiba Silicone Co., Ltd.) was dispersed in 55.0 g of methyl ethyl ketone using an ultrasonic homogenizer to obtain a particulate resin dispersion. Then, to the above-described protective layer resin solution 1 was added 3.0 g of a silica dispersion with stirring and the mixture was dispersed using a ultrasonic homogenizer to prepare protective layer coating solution 1.

Coating of Image Forming Layer Side

The thus prepared image forming layer coating solution 1 and protective layer coating solution 1 were coated on the plasma-treated surface of a support with a backing layer, using an extrusion coater and dried with hot air of 100° C. to obtain image-forming material sample 1-1. The thickness of the image forming layer was adjusted so as to have a silver coverage of 1.25±0.04 $g/m^2$ and the protective layer thickness was adjusted so as to have a coating amount of 2.50±0.05 $g/m^2$.

Image forming material samples 1-2 through 1-15 were prepared similarly to image forming material sample 1-1, provided that the composition of the protective layer was varied as shown in Table 1.

Image Formation and Evaluation

The thus prepared image forming material samples 1-1 through 1-15 were allowed to stand at room temperature (23° C., 55% RH) for 12 hrs. and imagewise heated from the protective layer side using thermal head KST-type (trade name, available from KYOCERA CORP.) to form an image, in which the thermal recording energy per unit area was adjusted with applied voltage and pulse width so as to form 64 tone steps.

The thus imagewise heated samples were evaluated with respect to sensitivity, maximum density and fogging according to the following procedure.

Sensitivity (S)

The samples were each subjected to densitometry with respect to visual transmission density of formed silver images, using a densitometer (PDA-65, available from Konica Corp., decimal significant figures of three). Sensitivity was defined as thermal energy giving a density of 1.0 above unheated area and represented by a relative value, based on the sensitivity of sample 1-1 being 100. Thus, in the cases where a more energy is needed than the standard value, the sensitivity is more than 100; and in the case of a less energy needed, the sensitivity is less than 100. The energy amount giving a density of 1.0 above an unheated area was measured at least three times within the density region of +0.7 to +1.2 above an unheated area and determined by linear regression.

Maximum Density (Dmax)

Visual transmission densities were measured at ten points in the maximum energy-applied area using a densitometer (PDA-65, available from Konica Corp., decimal significant figures of three) and an averaged value thereof was defined as the maximum density (Dmax).

Fog Density (Dmin)

Visual transmission densities were measured at ten points in unheated areas using a densitometer (PDA-65, available from Konica Corp., decimal significant figures of three) and an averaged value thereof was defined as a fog density (denoted as Dmin).

Evaluation of Bleeding

On one side of 188 μm thick biaxially stretched polyethylene terephthalate film (Lumilar T60, available from Toray), an image receiving layer coating solution described blow was coated using a bar coater so as to form a dry thickness of 20 μm to obtain an image receiving material.

| Image receiving layer coating solution | |
|---|---|
| Vinyl chloride resin 1 (Shinetsu PVC TK-500, Shi-Etsu Kagaku Kogyo) | 2.00 g |
| Vinyl chloride resin (UCAR VYHH, Dow Chemical Co.) | 18.0 g |
| Methyl ethyl ketone | 80 g |

The image forming material samples were evaluated with respect to fatty acid transferred onto the image receiving material according to the following procedure. The protective layer of each sample was superposed onto the image receiving layer of the image receiving material, and allowed to stand in an incubator at 150° C. for 30 min, while a load of 20 g/cm$^2$ being loaded thereto. Then, after returned to room temperature, the protective layer was peeled off from the image receiving later. Subsequently, 0.10 m$^2$ was extracted with methanol and the entire fatty acid was subjected to methylation using diazomethane according to the conventional manner. Thereafter, an amount of fatty acid transferred onto the image receiving was determined by the GC/MS analysis. The amount of the transferred fatty acid onto the image receiving material was represented by a relative value, based on that of image forming material sample 1-1 being 100. Results thereof are shown in Table 1.

Example 2

Preparation of Sample 2-1 to 2-19

In a solvent described in Table 2 was dissolved with stirring 20.0 g of a resin exhibiting a solubility parameter (δP), as shown in Table 2, and then, 0.50 g of a UV absorber (UBINAL 3035,available from BASF Co.), 0.10 g of a fluorinated surfactant (Surflon KH40 available from ASAHI Glass Co. Ltd.), a 20% solid silicone resin methyl ethyl ketone solution (Symac US352, available from Toa Gosei Co. Ltd.) and polyisocyanate compound of a solubility parameter (δh) and an amount, as shown in Table 2 were successively added and dissolved to prepare a protective layer resin solution 2. Separately, 5.0 g of silicone resin particles (Tospar 130, available from GE Toshiba Silicone Co., Ltd.) was dispersed in 55.0 g of methyl ethyl ketone using an ultrasonic homogenizer to obtain a particulate resin dispersion. Then, to the protective layer resin solution 2 was added 3.0 g of a silica dispersion with stirring and the mixture was dispersed using a ultrasonic homogenizer to prepare protective layer coating solution 2.

The image forming layer coating solution 1 used in Example 1 and the foregoing protective layer coating solution 2 were coated on the plasma-treated surface of a support with a backing layer used in Example 1, using an extrusion coater and dried with hot air of 100° C. to obtain image-forming material samples. The thickness of the image forming layer was adjusted so as to have a silver coating amount of 1.25±0.04 g/m$^2$ and the protective layer thickness was adjusted to 2.50±0.05 g/m$^2$.

Image Formation and Evaluation

Similarly to Example 1, samples 2-1 through 2-19 were thermally image-recorded and evaluated with respect to sensitivity (S), maximum density (Dmax) and minimum density (Dmin), and results thereof are shown in Table 2. The sensitivity was represented by a relative value, based on that of sample 2-1 being 100.

Further, similarly to Example 1, samples 2-1 through 2-19 were evaluated with respect to bleed-out. Results thereof are also shown in Table 2, in which the amount of the transferred fatty acid onto the image receiving material was represented by a relative value, based on that of image forming material sample 2-1 being 100.

TABLE 1

| Sample | Protective Layer | | Crosslinking | Image Evaluation | | | Fatty Acid | |
|---|---|---|---|---|---|---|---|---|
| No. | Solvent (g) | Resin | Agent (g) | S | Dmax | Dmin | Transfer | Remark |
| 1-1 | MEK (180) | B-19 | — | 100 | 3.15 | 0.223 | 100 | Comp. |
| 1-2 | MEK (180) | B-20 | — | 100 | 3.16 | 0.224 | 101 | Comp. |
| 1-3 | MEK/THF = 5/5 (115) | B-1 | 6.95 | 99 | 3.14 | 0.223 | 72 | Inv. |
| 1-4 | MEK/THF = 5/5 (115) | B-2 | 6.50 | 100 | 3.14 | 0.224 | 70 | Inv. |
| 1-5 | MEK (80) | B-3 | 5.00 | 100 | 3.13 | 0.224 | 67 | Inv. |
| 1-6 | MEK (80) | B-4 | 5.55 | 99 | 3.14 | 0.223 | 72 | Inv. |
| 1-7 | MEK/THF = 5/5 (115) | B-5 | 4.05 | 99 | 3.13 | 0.224 | 70 | Inv. |
| 1-8 | MEK/THF = 8/2 (80) | B-6 | 4.20 | 99 | 3.13 | 0.223 | 60 | Inv. |
| 1-9 | MEK (80) | B-7 | 4.75 | 100 | 3.13 | 0.223 | 69 | Inv. |
| 1-10 | MEK/THF = 5/5 (115) | B-8 | 4.10 | 99 | 3.14 | 0.223 | 65 | Inv. |
| 1-11 | MEK/THF = 8/2 (80) | B-9 | 4.40 | 100 | 3.14 | 0.223 | 62 | Inv. |
| 1-12 | MEK/THF = 8/2 (115) | B-14 | 4.35 | 100 | 3.14 | 0.224 | 70 | Inv. |
| 1-13 | MEK/THF = 8/2 (80) | B-15 | 3.60 | 100 | 3.13 | 0.224 | 59 | Inv. |
| 1-14 | MEK/THF = 8/2 (80) | B-16 | 3.90 | 100 | 3.14 | 0.224 | 61 | Inv. |
| 1-15 | MEK/THF = 8/2 (80) | B-17 | 3.75 | 99 | 3.13 | 0.224 | 61 | Inv. |

MEK: methyl ethyl ketone
THF: tetrahydroxyfurane

TABLE 2

| Sample No. | Protective Layer Solvent (g) | Resin (δp) | Crosslinking Agent (g/δh) | δh/δp | Image Evaluation S | Dmax | Dmin | Fatty Acid Transfer | Remark |
|---|---|---|---|---|---|---|---|---|---|
| 2-1 | MEK (180) | B-19 (20.4) | — | — | 100 | 3.15 | 0.223 | 100 | Comp. |
| 2-2 | MEK (180) | B-20 (20.5) | — | — | 100 | 3.16 | 0.224 | 101 | Comp. |
| 2-3 | MEK/THF = 5/5 (115) | B-2 (23.1) | H-1 (16.3/28.3) | 1.23 | 100 | 3.15 | 0.224 | 71 | Inv. |
| 2-4 | MEK (80) | B-3 (24.9) | H-1 (12.50/28.3) | 1.14 | 100 | 3.13 | 0.224 | 66 | Inv. |
| 2-5 | MEK (80) | B-3 (24.9) | H-2 (9.95/28.0) | 1.12 | 100 | 3.14 | 0.223 | 64 | Inv. |
| 2-6 | MEK (80) | B-3 (24.9) | H-3 (5.10/25.0) | 1.00 | 99 | 3.12 | 0.223 | 68 | Inv. |
| 2-7 | MEK (80) | B-4 (26.4) | H-1 (14.00/28.3) | 1.07 | 99 | 3.14 | 0.223 | 72 | Inv. |
| 2-8 | MEK/THF = 5/5 (115) | B-5 (28.9) | H-1 (10.05/28.3) | 0.98 | 100 | 3.12 | 0.224 | 71 | Inv. |
| 2-9 | MEK/THF = 8/2 (80) | B-6 (23.5) | H-1 (10.45/28.3) | 1.20 | 99 | 3.13 | 0.223 | 59 | Inv. |
| 2-10 | MEK (80) | B-7 (24.4) | H-1 (11.90/28.3) | 1.16 | 100 | 3.13 | 0.223 | 68 | Inv. |
| 2-11 | MEK/THF = 5/5 (115) | B-8 (25.2) | H-1 (10.25/28.3) | 1.12 | 99 | 3.13 | 0.223 | 65 | Inv. |
| 2-12 | MEK/THF = 8/2 (80) | B-9 (22.7) | H-1 (10.95/28.3) | 1.25 | 100 | 3.14 | 0.223 | 63 | Inv. |
| 2-13 | MEK/THF = 8/2 (80) | B-9 (22.7) | H-2 (8.70/28.0) | 1.23 | 99 | 3.13 | 0.223 | 61 | Inv. |
| 2-14 | MEK/THF = 8/2 (80) | B-9 (22.7) | H-3 (4.45/25.0) | 1.01 | 99 | 3.14 | 0.224 | 64 | Inv. |
| 2-15 | MEK/THF = 8/2 (115) | B-14 (23.5) | H-1 (10.90/28.3) | 1.20 | 100 | 3.13 | 0.223 | 69 | Inv. |
| 2-16 | MEK/THF = 8/2 (115) | B-14 (23.5) | H-2 (8.65/28.0) | 1.19 | 99 | 3.12 | 0.223 | 68 | Inv. |
| 2-17 | MEK/THF = 8/2 (115) | B-14 (23.5) | H-3 (4.45/25.0) | 1.06 | 99 | 3.13 | 0.224 | 72 | Inv. |
| 2-18 | MEK/THF = 8/2 (80) | B-15 (22.2) | H-1 (9.00/28.3) | 1.27 | 100 | 3.13 | 0.224 | 60 | Inv. |
| 2-19 | MEK/THF = 8/2 (80) | B-16 (23.8) | H-1 (9.70/28.3) | 1.19 | 100 | 3.13 | 0.224 | 61 | Inv. |

MEK: methyl ethyl ketone
THF: tetrahydroxyfurane
H-1: adduct of trimethylolpropane (1 mole) and tolylenediisocyanate (3 mole)
H-2: isocyanurate trimer of tolylenediisocyanate
H-3: 2-isicyanatoethyl-2,6-diisocyanatocaproate

Example 3

Preparation of Sample 3-1 to 3-13

In a solvent described in Table 3 was dissolved with stirring 20.0 g of a resin exhibiting a hydroxyl value, as shown in Table 3, and then, 0.50 g of a UV absorber (UBINAL 3035,available from BASF Co.), 0.10 g of a fluorinated surfactant (Surflon KH40 available from ASAHI Glass Co. Ltd.), a 20% solid silicone resin methyl ethyl ketone solution (Symac US352, available from Toa Gosei Co. Ltd.) and polyisocyanate compound (50% solid, Coronate C-3041, available from Nippon Polyurethane Ind. Co., Ltd.) in an amount, as shown in Table 3 were successively added and dissolved to prepare a protective layer resin solution 3. Separately, 5.0 g of silicone resin particles (Tospar 130, available from GE Toshiba Silicone. Co., Ltd.) was dispersed in 55.0 g of methyl ethyl ketone using a ultrasonic homogenizer to obtain a particulate resin dispersion. Then, to the protective layer resin solution 3 was added 3.0 g of a silica dispersion with stirring and the mixture was dispersed using a ultrasonic homogenizer to prepare protective layer coating solution 3.

The image forming layer coating solution 1 used in Example 1 and the foregoing protective layer coating solution 3 were coated on the plasma-treated surface of a support with a backing layer used in Example 1, using an extrusion coater and dried with hot air of 100° C. to obtain image-forming material samples. The thickness of the image forming layer was adjusted so as to have a silver coating amount of 1.25±0.04 g/m$^2$ and the protective layer thickness was adjusted to 2.50±0.05 g/m$^2$.

Image Formation and Evaluation

Similarly to Example 1, samples 3-1 through 3-13 were thermally image-recorded and evaluated with respect to sensitivity (S), maximum density (Dmax) and minimum density (Dmin), and results thereof are shown in Table 3. The sensitivity was represented by a relative value, based on that of sample 3-1 being 100.

Further, similarly to Example 1, samples 3-1 through 3-13 were evaluated with respect to bleed-out. Results thereof are also shown in Table 3, in which the amount of the transferred fatty acid onto the image receiving material was represented by a relative value, based on that of image forming material sample 3-1 being 100.

TABLE 3

| Sample No. | Protective Layer Solvent (g) | Resin (hydroxyl value) | Crosslinking Agent (g) | Image Evaluation S | Dmax | Dmin | Fatty Acid Transfer | Remark |
|---|---|---|---|---|---|---|---|---|
| 3-1 | MEK (180) | B-19 (59) | 0 | 100 | 3.15 | 0.223 | 100 | Comp. |
| 3-2 | THF (180) | B-21 (116) | 0 | 97 | 3.08 | 0.235 | 92 | Comp. |
| 3-3 | MEK (80) | B-3 (198) | 5.00 | 100 | 3.13 | 0.224 | 67 | Inv. |
| 3-4 | MEK (80) | B-4 (219) | 5.55 | 99 | 3.14 | 0.223 | 72 | Inv. |
| 3-5 | MEK/THF = 8/2 (80) | B-6 (165) | 4.20 | 99 | 3.13 | 0.223 | 60 | Inv. |
| 3-6 | MEK/THF = 8/2 (80) | B-9 (173) | 4.40 | 100 | 3.14 | 0.223 | 62 | Inv. |
| 3-7 | THF (115) | B-10 (183) | 4.65 | 99 | 3.14 | 0.226 | 66 | Inv. |

TABLE 3-continued

| Sample No. | Protective Layer Solvent (g) | Resin (hydroxyl value) | Crosslinking Agent (g) | Image Evaluation S | Dmax | Dmin | Fatty Acid Transfer | Remark |
|---|---|---|---|---|---|---|---|---|
| 3-8 | THF (115) | B-11 (168) | 4.25 | 99 | 3.13 | 0.225 | 70 | Inv. |
| 3-9 | THF (115) | B-12 (155) | 3.90 | 99 | 3.13 | 0.226 | 68 | Inv. |
| 3-10 | MEK/THF = 8/2 (115) | B-13 (208) | 5.25 | 99 | 3.14 | 0.223 | 65 | Inv. |
| 3-11 | MEK/THF = 8/2 (80) | B-15 (142) | 3.60 | 100 | 3.13 | 0.224 | 59 | Inv. |
| 3-12 | MEK/THF = 8/2 (80) | B-17 (148) | 3.75 | 99 | 3.13 | 0.224 | 61 | Inv. |
| 3-13 | THF (115) | B-18 (338) | 8.55 | 100 | 3.13 | 0.226 | 80 | Inv. |

MEK: methyl ethyl ketone
THF: tetrahydroxyfurane

Example 4

Preparation of Sample 4-1 to 4-29

To 50 g of the light-insensitive organic silver salt dispersion of Example 1, 10.0 g of methyl ethyl ketone was added and maintained at 20° C., and 12.68 g of poly(vinyl butyral) resin exhibiting a hydroxyl value, as shown in Table 4 was added thereto, then, 2.63 g of ethyl 3,4-hydroxybenzoate, 0.71 g of benzo[e][1,3]oxazine-2,4-dione, 0.36 g of 7-(ethylcarbonato)-benzo[e][1,3]oxazine-2,4-dione, 0.41 g of tetrachlorophthalic acid anhydride and 0.93 g of adipic acid were successively added, and stirred for 30 min. to obtain image forming layer coating solution 2.

In a solvent described in Table 4 was dissolved with stirring 20.0 g of a resin exhibiting a hydroxyl value, as shown in Table 4, and then, 0.50 g of a UV absorber (UBINAL 3035,available from BASF Co.), 0.10 g of a fluorinated surfactant (Surflon KH40 available from ASAHI Glass Co. Ltd.), a 20% solid silicone resin methyl ethyl ketone solution (Symac US352, available from Toa Gosei Co. Ltd.) and polyisocyanate compound (methyl ethyl ketone solution, 20% solid) of an amount, as shown in Table 4 were successively added and dissolved to prepare a protective layer resin solution 4. Separately, 5.0 g of silicone resin particles (Tospar 130, available from GE Toshiba Silicone Co., Ltd.) was dispersed in 55.0 g of methyl ethyl ketone using an ultrasonic homogenizer to obtain a particulate resin dispersion. Then, to the protective layer resin solution 3 was added 3.0 g of a silica dispersion with stirring and the mixture was dispersed using a ultrasonic homogenizer to prepare protective layer coating solution 4.

The foregoing image forming layer coating solution 2 and protective layer coating solution 4 were coated on the plasma-treated surface of a support with a backing layer used in Example 1, using an extrusion coater and dried with hot air of 100° C. to obtain image-forming material samples. The thickness of the image forming layer was adjusted so as to have a silver coating amount of 1.25±0.04 g/m$^2$ and the protective layer thickness was adjusted to 2.50±0.05 g/m$^2$.

Image Formation and Evaluation

Similarly to Example 1, samples 4-1 through 4-29 were thermally image-recorded and evaluated with respect to sensitivity (S), maximum density (Dmax) and minimum density (Dmin), and results thereof are shown in Table 4. The sensitivity was represented by a relative value, based on that of sample 4-1 being 100.

Further, similarly to Example 1, samples 4-1 through 4-29 were evaluated with respect to bleed-out. Results thereof are also shown in Table 4, in which the amount of the transferred fatty acid onto the image receiving material was represented by a relative value, based on that of image forming material sample 4-1 being 100.

TABLE 4

| Sample No. | Image Forming Layer Resin (A) | Protective Layer Solvent (g) | Resin (B) | Cross-linking Agent (g) | B/A | Image Evaluation S | Dmax | Dmin | Fatty Acid Transfer | Remark |
|---|---|---|---|---|---|---|---|---|---|---|
| 4-1 | B-22 (175) | MEK (180) | B-19 (59) | — | 0.34 | 100 | 3.15 | 0.223 | 100 | Comp. |
| 4-2 | B-22 (175) | MEK (180) | B-20 (36) | — | 0.21 | 100 | 3.16 | 0.224 | 101 | Comp. |
| 4-3 | B-22 (175) | MEK/THF = 5/5 (115) | B-1 (275) | H-4 (17.35) | 1.57 | 99 | 3.14 | 0.223 | 72 | Inv. |
| 4-4 | B-22 (175) | MEK (80) | B-3 (198) | H-4 (12.50) | 1.13 | 100 | 3.13 | 0.224 | 66 | Inv. |
| 4-5 | B-22 (175) | MEK (80) | B-3 (198) | H-5 (9.95) | 1.13 | 100 | 3.14 | 0.223 | 64 | Inv. |
| 4-6 | B-22 (175) | MEK (80) | B-3 (198) | H-6 (5.10) | 1.13 | 99 | 3.12 | 0.223 | 68 | Inv. |
| 4-7 | B-22 (175) | MEK (80) | B-4 (219) | H-4 (13.80) | 1.25 | 99 | 3.14 | 0.223 | 72 | Inv. |
| 4-8 | B-22 (175) | MEK (80) | B-4 (219) | H-5 (11.00) | 1.25 | 99 | 3.13 | 0.224 | 69 | Inv. |
| 4-9 | B-22 (175) | MEK (80) | B-4 (219) | H-6 (5.65) | 1.25 | 98 | 3.12 | 0.222 | 73 | Inv. |
| 4-10 | B-22 (175) | MEK/THF = 8/2 (80) | B-6 (165) | H-4 (10.40) | 0.94 | 99 | 3.13 | 0.223 | 59 | Inv. |
| 4-11 | B-22 (175) | MEK/THF = 8/2 (80) | B-9 (173) | H-4 (10.90) | 0.98 | 100 | 3.14 | 0.223 | 63 | Inv. |
| 4-12 | B-22 (175) | MEK/THF = 8/2 (80) | B-9 (173) | H-5 (8.70) | 0.98 | 99 | 3.13 | 0.223 | 61 | Inv. |
| 4-13 | B-22 (175) | MEK/THF = 8/2 (80) | B-9 (173) | H-6 (4.45) | 0.98 | 99 | 3.14 | 0.224 | 64 | Inv. |
| 4-14 | B-22 (175) | MEK/THF = 8/2 (115) | B-14 (172) | H-4 (10.85) | 0.98 | 100 | 3.13 | 0.223 | 69 | Inv. |
| 4-15 | B-22 (175) | MEK/THF = 8/2 (80) | B-15 (142) | H-4 (8.95) | 0.81 | 100 | 3.13 | 0.224 | 60 | Inv. |
| 4-16 | B-22 (175) | MEK/THF = 8/2 (80) | B-15 (142) | H-5 (7.15) | 0.81 | 99 | 3.12 | 0.223 | 57 | Inv. |
| 4-17 | B-22 (175) | MEK/THF = 8/2 (80) | B-15 (142) | H-6 (3.65) | 0.81 | 99 | 3.11 | 0.223 | 62 | Inv. |

TABLE 4-continued

| Sample No. | Image Forming Layer Resin (A) | Protective Layer Solvent (g) | Resin (B) | Cross-linking Agent (g) | B/A | Image Evaluation S | Dmax | Dmin | Fatty Acid Transfer | Remark |
|---|---|---|---|---|---|---|---|---|---|---|
| 4-18 | B-22 (175) | MEK/THF = 8/2 (80) | B-16 (153) | H-4 (9.65) | 0.87 | 100 | 3.13 | 0.224 | 61 | Inv. |
| 4-19 | B-22 (175) | MEK/THF = 8/2 (80) | B-17 (148) | H-4 (9.35) | 0.85 | 99 | 3.13 | 0.223 | 62 | Inv. |
| 4-20 | B-23 (155) | MEK (80) | B-3 (198) | H-4 (12.50) | 1.28 | 99 | 3.15 | 0.226 | 69 | Inv. |
| 4-21 | B-23 (155) | MEK (80) | B-4 (219) | H-4 (13.80) | 1.41 | 98 | 3.16 | 0.224 | 74 | Inv. |
| 4-22 | B-23 (155) | MEK/THF = 8/2 (80) | B-9 (173) | H-4 (10.90) | 1.12 | 99 | 3.15 | 0.224 | 66 | Inv. |
| 4-23 | B-23 (155) | MEK/THF = 8/2 (80) | B-15 (142) | H-4 (8.95) | 0.92 | 99 | 3.14 | 0.225 | 62 | Inv. |
| 4-24 | B-23 (155) | MEK/THF = 8/2 (80) | B-16 (153) | H-4 (9.65) | 0.99 | 99 | 3.15 | 0.225 | 63 | Inv. |
| 4-25 | B-24 (260) | MEK (80) | B-3 (198) | B-4 (12.50) | 0.76 | 103 | 3.03 | 0.225 | 62 | Inv. |
| 4-26 | B-24 (260) | MEK (80) | B-4 (219) | H-4 (13.80) | 0.84 | 103 | 3.04 | 0.226 | 70 | Inv. |
| 4-27 | B-24 (260) | MEK/THF = 8/2 (80) | B-9 (173) | H-4 (10.90) | 0.67 | 103 | 3.02 | 0.225 | 60 | Inv. |
| 4-28 | B-24 (260) | MEK/THF = 8/2 (80) | B-15 (142) | H-4 (8.95) | 0.55 | 103 | 3.02 | 0.225 | 58 | Inv. |
| 4-29 | B-24 (260) | MEK/THF = 8/2 (80) | B-16 (153) | H-4 (9.65) | 0.59 | 103 | 3.03 | 0.226 | 58 | Inv. |

A: hydroxyl value
B: hydroxyl value
MEK: methyl ethyl ketone
THF: tetrahydroxyfurane
H-4: adduct of trimethylolpropane (1 mole) and tolylenediisocyanate (3 mole)
H-5: isocyanurate trimer of tolylenediisocyanate
H-6: 2-isicyanatoethyl-2,6-diisocyanatocaproate

Example 5

Preparation of Image Forming Material

Preparation of Light-sensitive Silver Halide Emulsion 1

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous halide solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 12 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain light-sensitive silver halide emulsion 1.

Preparation of Light-sensitive Organic Silver Salt A

In 4720 ml water were dissolved 171.2 g of behenic acid, 49.4 g of arachidic acid and 34.4 g of stearic acid at 80° C. Then, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion 1 obtained above (containing equivalent to 0.038 mol silver) and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air at 37° C. until no reduction in weight was detected to obtain powdery light-sensitive organic silver salt A.

Preparation of Light-sensitive Dispersion A

In 291.4 g methyl ethyl ketone was dissolved 2.91 g of poly(vinyl butyral) resin (S-lec BL-5Z, hydroxyl value of 175, available from Sekisui Chemical Co., Ltd.) and further thereto was gradually added 100 g of the light-sensitive organic silver salt A with stirring by a dissolver type homogenizer. Thereafter, the mixture was dispersed using a media type dispersion machine (available from Gettzmann Corp.), which was packed 0.5 mm Zr beads (available from Toray Co. Ltd.) by 80%, at a circumferential speed of 13 m and for 0.5 min. of a retention time with a mill to obtain an emulsified light-sensitive dispersion A.

The foregoing light-sensitive dispersion A of 50 g and 10.0 g of methyl ethyl ketone were mixed and maintained at 18° C., and 0.312 g of antifoggant 1 methanol solution (11.2%) was added thereto and stirred for 1 hr. Further thereto, 0.418 g of calcium bromide methanol solution (11.2%) was added and stirred for 20 min. Further thereto was added 0.337 g of a solution, in which 0.894 g of dibenzo-18-crown-6 and 0.279 g of potassium acetate were dissolved in 10.0 g of methanol. Subsequently, 4.753 g of a dye solution shown below was added thereto and stirred for 60 min. and then cooled to a temperature of 13° C. and further stirred for 50 min.

| Dye solution | |
|---|---|
| Infrared sensitizing dye 1 | 0.0148 g |
| (2-Carboxyphenyl)-4-methylbebzebesulfonate | 6.372 g |
| 2-Chlorobenzoic acid | 0.739 g |
| Methyl ethyl ketone | 40.00 g |

Further thereto, 0.399 g of a methanol solution (0.94%) of a thiuronium compound (Exemplified compound, T-7) was added and after stirred for 5 min., 15.32 g of poly(vinyl butyral) (S-lec BL-5Z, hydroxyl value of 175, available from Sekisui Chemical Co., Ltd.) and stirred for 10 min., then, 0.180 g of tetrachlorophthalic acid were added thereto and stirred for 30 min.

To this solution, the following solutions 1, 2, 3, 4 and 5 were successively added in amounts of 0.974 g, 2.989 g, 13.543 g, 3.570 g and 6.461 g, respectively to prepare an image forming layer coating solution 3.

| Solution 1 |
|---|
| Methyl ethyl ketone solution of isocyanate compound (50% solid, Coronate HX, available from Nippon Polyurethane Ind. Co., Ltd.) |
| Solution 2 |
| Methyl ethyl ketone solution of potassium p-toluenethiosulfonate (1.20% solid) |

-continued

| Solution 3 | |
|---|---|
| 1,1-bis(2-hydroxy-3,5-dimethylphenyl)-(2,4-dimethyl-3-cyclohexyl)methane | 10.57 g |
| 4-Methlphthalic acid | 0.588 g |
| Infrared dye 1 | 0.0354 g |
| Methyl ethyl ketone | 50.00 g |
| Solution 4 | |
| Methyl ethyl ketone solution of compound p-54 comtaining a trihalomethyl group (10.85% solid) | |
| Solution 5 | |
| Methyl ethyl ketone solution of phthalazine (6.63% solid) | |

Antifoggant 1

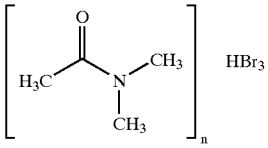

Infrared sensitizing dye 1

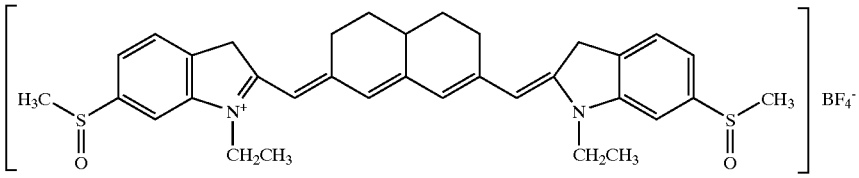

Infrared dye 1

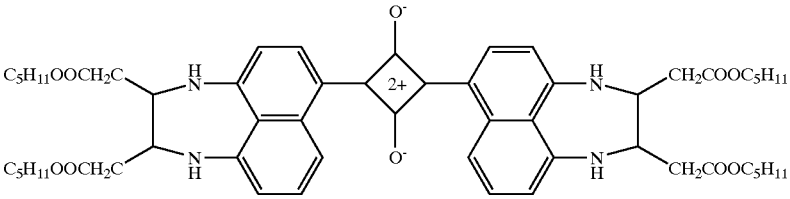

Preparation of Protective Layer Coating Solution

In a solvent shown in Table 5 were dissolved 10.05 g of a resin shown in Table 5, 0.013 g of benzotriazole and 0.10 g fluorinated surfactant (Surflon KH40 available from ASAHI Glass Co. Ltd.), then, polyisocyanate compound (50% solid, Coronate 3041, available from Nippon Polyurethane Ind. Co., Ltd.) was added thereto in an amount shown in Table 5 to prepared a protective layer resin solution 5. Separately, 5.0 g of hydrophobic silica (SYLOPHOBIC 200, available from FUJI SILYSIA Co.) was dispersed in 55.0 g of methyl ethyl ketone using an ultrasonic homogenizer to obtain a silica dispersion. Then, to the protective layer resin solution 5 was added 3.0 g of a silica dispersion with stirring and the mixture was dispersed using a ultrasonic homogenizer to prepare protective layer coating solution 5.

Coating of Image Forming Layer Side

The thus prepared image forming layer coating solution 3 and protective layer coating solution 5 were coated on the plasma-treated surface of a support with a backing layer used in Example 1, using an extrusion coater, and dried with hot air of 70° C. to obtain image-forming material samples 5-1 through 5-20. The thickness of the image forming layer was adjusted so as to have a silver coating amount of 1.55±0.05 g/m$^2$ and the protective layer thickness was adjusted to 2.50±0.05 g/m$^2$.

TABLE 5

| Sample No. | Protective Layer Solvent (g) | Resin | Crosslinking Agent (g) | Image Evaluation S | Dmax | Dmin | Fatty Acid Transfer *1 | *2 | *3 | Remark |
|---|---|---|---|---|---|---|---|---|---|---|
| 5-1 | MEK (90) | B-19 | 0 | 100 | 3.28 | 0.205 | 100 | 100 | 100 | Comp. |
| 5-2 | MEK (90) | B-20 | 0 | 100 | 3.27 | 0.206 | 98 | 99 | 95 | Comp. |
| 5-3 | MEK/THF = 5/5 (57.5) | B-1 | 3.48 | 101 | 3.31 | 0.205 | 82 | 80 | 76 | Inv. |
| 5-4 | MEK/THF = 5/5 (57.5) | B-2 | 3.25 | 100 | 3.30 | 0.207 | 79 | 77 | 74 | Inv. |
| 5-5 | MEK (40) | B-3 | 2.50 | 100 | 3.30 | 0.206 | 76 | 75 | 71 | Inv. |
| 5-6 | MEK (40) | B-4 | 2.75 | 101 | 3.32 | 0.206 | 79 | 78 | 75 | Inv. |
| 5-7 | MEK/THF = 5/5 (57.5) | B-5 | 2.05 | 101 | 3.31 | 0.207 | 78 | 76 | 73 | Inv. |
| 5-8 | MEK/THF = 8/2 (40) | B-6 | 2.10 | 100 | 3.31 | 0.206 | 65 | 64 | 62 | Inv. |
| 5-9 | MEK (40) | B-7 | 2.38 | 100 | 3.30 | 0.207 | 80 | 78 | 75 | Inv. |
| 5-10 | MEK/THF = 5/5 (57.5) | B-8 | 2.05 | 101 | 3.32 | 0.206 | 73 | 72 | 68 | Inv. |
| 5-11 | MEK/THF = 8/2 (40) | B-9 | 2.20 | 100 | 3.32 | 0.207 | 69 | 67 | 64 | Inv. |
| 5-12 | THF (57.5) | B-10 | 2.30 | 101 | 3.31 | 0.211 | 71 | 69 | 68 | Inv. |
| 5-13 | THF (57.5) | B-11 | 2.15 | 100 | 3.30 | 0.210 | 76 | 75 | 72 | Inv. |
| 5-14 | THF (57.5) | B-12 | 1.95 | 101 | 3.30 | 0.212 | 73 | 72 | 70 | Inv. |
| 5-15 | MEK/THF = 8/2 (57.5) | B-13 | 2.65 | 101 | 3.32 | 0.207 | 71 | 70 | 67 | Inv. |
| 5-16 | MEK/THF = 8/2 (57.5) | B-14 | 2.18 | 100 | 3.32 | 0.207 | 79 | 77 | 73 | Inv. |
| 5-17 | MEK/THF = 8/2 (40) | B-15 | 1.80 | 100 | 3.30 | 0.206 | 66 | 64 | 62 | Inv. |
| 5-18 | MEK/THF = 8/2 (40) | B-16 | 1.95 | 100 | 3.31 | 0.207 | 67 | 66 | 64 | Inv. |
| 5-19 | MEK/THF = 8/2 (40) | B-17 | 1.90 | 101 | 3.30 | 0.207 | 66 | 65 | 63 | Inv. |
| 5-20 | THF (57.5) | B-18 | 4.00 | 100 | 3.31 | 0.212 | 90 | 88 | 84 | Inv. |

*1: Stearic acid; *2: Arachidic acid; *3: Behenic acid
MEK: methyl ethyl ketone
THF: tetrahydroxyfurane

Image Formation and Evaluation

Image forming material samples 5-1 through 5-20, which were aged under the light-shielding at room temperature (23° C., 50% RH) for 12 hrs., were exposed and thermally developed using a dry imager Dry Pro 722 (available from Konica Corp.) with inputting optimum signals suitable for the following evaluation.

The thus thermally developed samples 5-1 through 5-20 were evaluated with respect to sensitivity, maximum density, fog density according to the following manner.

Sensitivity (S)

The samples were each subjected to densitometry with respect to visual transmission density of formed silver images, using a densitometer (PDA-65, available from Konica Corp., decimal significant figures of three). Sensitivity was defined as the reciprocal of an exposure amount giving a density of 1.0 above an unexposed area and represented by a relative value, based on the sensitivity of sample 5-1 being 100. The exposure amount giving a density of 1.0 above an unexposed area was measured at least three times within the density region of +0.7 to +1.2 above an unexposed area and determined by linear regression.

Maximum Density (Dmax)

Visual transmission densities were measured at ten points in the maximum exposure area using a densitometer (PDA-65, available from Konica Corp., decimal significant figures of three) and an averaged value thereof was defined as the maximum density (Dmax).

Fog Density (Dmin)

Visual transmission densities were measured at ten points in unexposed areas using a densitometer (PDA-65, available from Konica Corp., decimal significant figures of three) and an averaged value thereof was defined as a fog density (denoted as Dmin).

Evaluation of Bleeding

The image forming material samples were evaluated with respect to bleeding out, based on fatty acid transferred onto the image receiving material according to the following procedure. After allowed to stand under room light of 500 lux for 1 hr., the protective layer of each sample was superposed onto the image receiving layer of the image receiving material prepared in Example 1, and allowed to stand in an incubator at 130° C. for 30 min, while a load of 20 g/cm$^2$ being loaded thereto. Then, after returned to room temperature, the protective layer was peeled off from the image receiving layer. Subsequently, 0.10 m$^2$ was extracted with methanol and the entire fatty acid was subjected to methylation using diazomethane according to the conventional manner. Thereafter, an amount of fatty acid transferred onto the image receiving was determined by the GC/MS analysis. The amount of the transferred fatty acid onto the image receiving material was represented by a relative value, based on that of image forming material sample 5-1 being 100.

Results thereof are shown in Table 5.

Example 6

Preparation of Sample 6-1 to 6-23

In a solvent shown in Table 6 were dissolved 10.05 g of a resin exhibiting a solubility parameter (δp) shown in Table 6, 0.013 g of benzotriazole and 0.10 g fluorinated surfactant (Surflon KH40 available from ASAHI Glass Co. Ltd.), then, a methyl ethyl ketone solution of a polyisocyanate compound exhibiting a solubility parameter (δh) shown in Table 6 (20% solid) was added thereto in an amount shown in Table 6 to prepared a protective layer resin solution 6. Separately, 5.0 g of hydrophobic silica (SYLOPHOBIC 200, available from FUJI SILYSIA Co.) was dispersed in 55.0 g of methyl ethyl ketone using an ultrasonic homogenizer to obtain a silica dispersion. Then, to the protective layer resin solution 6 was added 3.0 g of a silica dispersion with stirring and the mixture was dispersed using a ultrasonic homogenizer to prepare protective layer coating solution 6.

The image forming layer coating solution 3 of Example 5 and the protective layer coating solution 6 were coated on the plasma-treated surface of a support with a backing layer used in Example 1, using an extrusion coater, and dried with hot air of 70° C. to obtain image-forming material samples 6-1 through 6-23. The thickness of the image forming layer was adjusted so as to have a silver coating amount of 1.85±0.05 g/m$^2$ and the protective layer thickness was adjusted to 2.50±0.05 g/m$^2$.

Image Formation and Evaluation

Similarly to Example 5, samples 6-1 through 6-23 were image-recorded and evaluated with respect to sensitivity (S), maximum density (Dmax) and minimum density (Dmin), and results thereof are shown in Table 6. The sensitivity was represented by a relative value, based on that of sample 6-1 being 100.

Further, similarly to Example 5, samples 6-1 through 6-23 were evaluated with respect to bleeding-out of compounds on the surface. Results thereof are also shown in Table 6, in which the amount of the transferred fatty acid onto the surface of the image receiving material was represented by a relative value, based on that of image forming material sample 6-1 being 100.

TABLE 6

| Sample | Protective Layer | | | | Image Evaluation | | | Fatty Acid Transfer | | | |
|---|---|---|---|---|---|---|---|---|---|---|---|
| No. | Solvent (g) | Resin (δp) | Crosslinking Agent (g/δh) | δh/δp | S | Dmax | Dmin | *1 | *2 | *3 | Remark |
| 6-1 | MEK (90) | B-19 (20.4) | — | — | 100 | 3.28 | 0.205 | 100 | 100 | 100 | Comp. |
| 6-2 | MEK (90) | B-20 (20.5) | — | — | 100 | 3.27 | 0.206 | 98 | 99 | 95 | Comp. |
| 6-3 | MEK/THF = 5/5 (57.5) | B-2 (23.1) | H-7 (8.15/28.3) | 1.23 | 100 | 3.31 | 0.206 | 80 | 78 | 74 | Inv. |
| 6-4 | MEK (40) | B-3 (24.9) | H-7 (6.25/28.3) | 1.14 | 100 | 3.30 | 0.206 | 76 | 75 | 70 | Inv. |
| 6-5 | MEK (40) | B-3 (24.9) | H-8 (4.95/28.0) | 1.12 | 100 | 3.31 | 0.205 | 74 | 72 | 67 | Inv. |
| 6-6 | MEK (40) | B-3 (24.9) | H-9 (2.55/25.0) | 1.00 | 101 | 3.32 | 0.206 | 81 | 78 | 72 | Inv. |
| 6-7 | MEK (40) | B-4 (26.4) | H-7 (6.95/28.3) | 1.07 | 101 | 3.31 | 0.205 | 79 | 78 | 74 | Inv. |
| 6-8 | MEK (40) | B-4 (26.4) | H-8 (5.55/28.0) | 1.06 | 101 | 3.30 | 0.206 | 78 | 76 | 71 | Inv. |
| 6-9 | MEK (40) | B-4 (26.4) | H-9 (2.85/25.0) | 0.95 | 101 | 3.31 | 0.207 | 83 | 81 | 76 | Inv. |
| 6-10 | MEK/THF = 8/2 (40) | B-6 (23.5) | H-7 (5.22/28.3) | 1.20 | 101 | 3.30 | 0.206 | 65 | 64 | 61 | Inv. |
| 6-11 | MEK (40) | B-7 (24.4) | H-7 (5.95/28.3) | 1.16 | 100 | 3.31 | 0.206 | 80 | 78 | 74 | Inv. |
| 6-12 | MEK/THF = 5/5 (57.5) | B-8 (25.2) | H-7 (5.15/28.3) | 1.12 | 101 | 3.31 | 0.205 | 73 | 71 | 67 | Inv. |
| 6-13 | MEK/THF = 8/2 (40) | B-9 (22.7) | H-7 (5.50/28.3) | 1.25 | 100 | 3.32 | 0.206 | 69 | 68 | 63 | Inv. |
| 6-14 | MEK/THF = 8/2 (40) | B-9 (22.7) | H-8 (4.40/28.0) | 1.23 | 101 | 3.31 | 0.206 | 66 | 65 | 60 | Inv. |
| 6-15 | MEK/THF = 8/2 (40) | B-9 (22.7) | H-9 (2.25/25.0) | 1.10 | 101 | 3.32 | 0.207 | 73 | 71 | 67 | Inv. |
| 6-16 | MEK/THF = 8/2 (57.5) | B-14 (23.5) | H-7 (5.45/28.3) | 1.20 | 100 | 3.31 | 0.206 | 78 | 76 | 72 | Inv. |
| 6-17 | MEK/THF = 8/2 (40) | B-15 (22.2) | H-7 (4.50/28.3) | 1.27 | 101 | 3.3 | 0.206 | 67 | 65 | 61 | Inv. |
| 6-18 | MEK/THF = 8/2 (40) | B-15 (22.2) | H-8 (3.60/28.0) | 1.26 | 100 | 3.31 | 0.206 | 62 | 61 | 57 | Inv. |
| 6-19 | MEK/THF = 8/2 (40) | B-15 (22.2) | H-9 (1.85/25.0) | 1.13 | 102 | 3.32 | 0.207 | 70 | 68 | 65 | Inv. |
| 6-20 | MEK/THF = 8/2 (40) | B-16 (23.8) | H-7 (4.85/28.3) | 1.19 | 100 | 3.31 | 0.207 | 67 | 66 | 64 | Inv. |
| 6-21 | MEK/THF = 8/2 (40) | B-17 (22.8) | H-7 (4.65/28.3) | 1.24 | 101 | 3.30 | 0.207 | 66 | 65 | 63 | Inv. |
| 6-22 | MEK/THF = 8/2 (40) | B-17 (22.8) | H-8 (3.70/28.0) | 1.23 | 101 | 3.30 | 0.207 | 64 | 63 | 60 | Inv. |
| 6-23 | MEK/THF = 8/2 (40) | B-17 (22.8) | H-9 (1.90/25.0) | 1.10 | 102 | 3.32 | 0.207 | 71 | 71 | 68 | Inv. |

*1: Stearic acid; *2: Arachidic acid; *3: Behenic acid

MEK: methyl ethyl ketone; THF: tetrahydroxyfurane

H-7: adduct of trimethylolpropane (1 mole) and tolylenediisocyanate (3 mole)

H-8: isocyanurate trimer of tolylenediisocyanate

H-9: 2-isicyanatoethyl-2,6-diisocyanatocaproate

Example 7

Preparation of Sample 7-1 to 7-31

In 291.4 g of methyl ethyl ketone was dissolved 2.91 g of poly(vinyl butyral) resin exhibiting a hydroxy value shown in Table 7 and further thereto was gradually added 100 g of the light-sensitive organic silver salt A of Example 5 with stirring by a dissolver type homogenizer. Thereafter, the mixture was dispersed using a media type dispersion machine (available from Gettzmann Corp.), which was packed 0.5 mm Zr beads (available from Toray Co. Ltd.) by 80%, at a circumferential speed of 13 m and for 0.5 min. of a retention time with a mill to obtain an emulsified light-sensitive dispersion B.

The foregoing light-sensitive dispersion B of 50 g and 10.0 g of methyl ethyl ketone were mixed and maintained at 18° C., and 0.312 g of antifoggant 1 methanol solution (11.2%) was added thereto and stirred for 1 hr. Further thereto, 0.418 g of calcium bromide methanol solution (11.2%) was added and stirred for 20 min. Further thereto was added 0.337 g of a solution, in which 0.894 g of dibenzo-18-crown-6 and 0.279 g of potassium acetate were dissolved in 10.0 g of methanol. Subsequently, 4.753 g of a dye solution shown below was added thereto and stirred for 60 min. and then cooled to a temperature of 13° C. and further stirred for 50 min.

| Dye solution | |
|---|---|
| Infrared sensitizing dye 1 | 0.0148 g |
| (2-Carboxyphenyl)-4-methylbebzebesulfonate | 6.372 g |
| 2-Chlorobenzoic acid | 0.739 g |
| Methyl ethyl ketone | 40.00 g |

Further thereto, 0.399 g of a methanol solution (0.94%) of a thiuronium compound (Exemplified compound, T-7) was added and after stirred for 5 min., 15.32 g of poly(vinyl butyral) exhibiting a hydroxyl value shown in Table 7 and stirred for 10 min., then, 0.180 g of tetrachlorophthalic acid were added thereto and stirred for 30 min.

To this solution, the following solutions 1, 2, 3, 4 and 5 used in Example 5 were successively added in amounts of 0.974 g, 2.989 g, 13.543 g, 3.570 g and 6.461 g, respectively to prepare an image forming layer coating solution 4.

In a solvent shown in Table 6 were dissolved 10.05 g of a resin exhibiting a hydroxyl value shown in Table 7, 0.013 g of benzotriazole and 0.10 g fluorinated surfactant (Surflon KH40 available from ASAHI Glass Co. Ltd.), then, a methyl ethyl ketone solution of a polyisocyanate compound (50% solid, Coronate 3041, available from Nippon Polyurethane Ind. Co., Ltd.) was added thereto in an amount shown in Table 7 to prepared a protective layer resin solution 7. Separately, 5.0 g of hydrophobic silica (SYLOPHOBIC 200, available from FUJI SILYSIA Co.) was dispersed in 55.0 g of methyl ethyl ketone using an ultrasonic homogenizer to obtain a silica dispersion. Then, to the protective layer resin solution 7 was added 3.0 g of a silica dispersion with stirring and the mixture was dispersed using a ultrasonic homogenizer to prepare protective layer coating solution 7.

The image forming layer coating solution 4 and the protective layer coating solution 7 were coated on the plasma-treated surface of a support with a backing layer used in Example 1, using an extrusion coater, and dried with hot air of 70° C. to obtain image-forming material samples 7-1 through 7-31. The thickness of the image forming layer was adjusted so as to have a silver coating amount of 1.85±0.05 g/m$^2$ and the protective layer thickness was adjusted to 2.50±0.05 g/m$^2$.

Image Formation and Evaluation

Similarly to Example 5, samples 7-1 through 7-31 were image-recorded and evaluated with respect to sensitivity (S), maximum density (Dmax) and minimum density (Dmin), and results thereof are shown in Table 7. The sensitivity was represented by a relative value, based on that of sample 7-1 being 100.

Further, similarly to Example 5, samples 7-1 through 7-31 were evaluated with respect to bleeding-out of compounds on the surface. Results thereof are also shown in Table 7, in which the amount of the transferred fatty acid onto the surface of the image receiving material was represented by a relative value, based on that of image forming material sample 7-1 being 100.

TABLE 7

| Sample No. | Image Forming Layer Resin (A) | Protective Layer Solvent (g) | (Resin (B) | Crosslinking Agent (g) | B/A | Image Evaluation S | Dmax | Dmin | Fatty Acid Transfer *1 | *2 | *3 | Remark |
|---|---|---|---|---|---|---|---|---|---|---|---|---|
| 7-1 | B-22 (175) | MEK (180) | B-19 (59) | — | 0.34 | 100 | 3.28 | 0.205 | 100 | 100 | 100 | Comp. |
| 7-2 | B-22 (175) | MEK (180) | B-20 (36) | — | 0.21 | 100 | 3.27 | 0.206 | 98 | 99 | 95 | Comp. |
| 7-3 | B-22 (175) | MEK/THF = 5/5 (115) | B-1 (275) | H-10 (8.70) | 1.57 | 101 | 3.33 | 0.206 | 83 | 81 | 75 | Inv. |
| 7-4 | B-22 (175) | MEK (80) | B-3 (198) | H-10 (6.25) | 1.13 | 100 | 3.30 | 0.206 | 76 | 75 | 70 | Inv. |
| 7-5 | B-22 (175) | MEK (80) | B-3 (198) | H-11 (4.95) | 1.13 | 100 | 3.31 | 0.205 | 74 | 72 | 67 | Inv. |
| 7-6 | B-22 (175) | MEK (80) | B-3 (198) | H-12 (2.55) | 1.13 | 101 | 3.32 | 0.206 | 81 | 78 | 72 | Inv. |
| 7-7 | B-22 (175) | MEK (80) | B-4 (219) | H-10 (6.90) | 1.25 | 101 | 3.31 | 0.205 | 79 | 78 | 74 | Inv. |
| 7-8 | B-22 (175) | MEK (80) | B-4 (219) | H-11 (5.50) | 1.25 | 101 | 3.30 | 0.206 | 78 | 76 | 71 | Inv. |
| 7-9 | B-22 (175) | MEK (80) | B-4 (219) | H-12 (2.80) | 1.25 | 101 | 3.31 | 0.207 | 83 | 81 | 76 | Inv. |
| 7-10 | B-22 (175) | MEK/THF = 8/2 (80) | B-6 (165) | H-10 (5.20) | 0.94 | 101 | 3.30 | 0.206 | 65 | 64 | 61 | Inv. |
| 7-11 | B-22 (175) | MEK (80) | B-7 (188) | H-10 (5.95) | 1.07 | 100 | 3.31 | 0.206 | 80 | 78 | 74 | Inv. |
| 7-12 | B-22 (175) | MEK/THF = 5/5 (115) | B-8 (162) | H-10 (5.10) | 0.93 | 101 | 3.31 | 0.205 | 73 | 71 | 67 | Inv. |
| 7-13 | B-22 (175) | MEK/THF = 8/2 (80) | B-9 (173) | H-10 (5.45) | 0.98 | 100 | 3.32 | 0.206 | 69 | 68 | 63 | Inv. |
| 7-14 | B-22 (175) | MEK/THF = 8/2 (80) | B-9 (173) | H-11 (4.35) | 0.98 | 101 | 3.31 | 0.206 | 66 | 65 | 60 | Inv. |

TABLE 7-continued

| Sample No. | Image Forming Layer Resin (A) | Protective Layer Solvent (g) | (Resin (B) | Crosslinking Agent (g) | B/A | Image Evaluation S | Dmax | Dmin | Fatty Acid Transfer *1 | *2 | *3 | Remark |
|---|---|---|---|---|---|---|---|---|---|---|---|---|
| 7-15 | B-22 (175) | MEK/THF = 8/2 (80) | B-9 (173) | H-12 (2.20) | 0.98 | 101 | 3.32 | 0.207 | 73 | 71 | 67 | Inv. |
| 7-16 | B-22 (175) | MEK/THF = 8/2 (115) | B-14 (172) | H-10 (5.45) | 0.98 | 100 | 3.31 | 0.206 | 78 | 76 | 72 | Inv. |
| 7-17 | B-22 (175) | MEK/THF = 8/2 (80) | B-15 (142) | H-10 (4.50) | 0.81 | 101 | 3.30 | 0.206 | 67 | 65 | 61 | Inv. |
| 7-18 | B-22 (175) | MEK/THF = 8/2 (80) | B-15 (142) | H-11 (3.55) | 0.81 | 100 | 3.31 | 0.206 | 62 | 61 | 57 | Inv. |
| 7-19 | B-22 (175) | MEK/THF = 8/2 (80) | B-15 (142) | H-12 (1.80) | 0.81 | 102 | 3.32 | 0.207 | 70 | 68 | 65 | Inv. |
| 7-20 | B-22 (175) | MEK/THF = 8/2 (80) | B-16 (153) | H-10 (4.85) | 0.87 | 100 | 3.31 | 0.207 | 67 | 66 | 64 | Inv. |
| 7-21 | B-22 (175) | MEK/THF = 8/2 (80) | B-17 (148) | H-10 (4.65) | 0.85 | 101 | 3.30 | 0.207 | 66 | 65 | 63 | Inv. |
| 7-22 | B-23 (155) | MEK (80) | B-3 (198) | H-10 (6.25) | 1.28 | 102 | 3.32 | 0.208 | 79 | 77 | 73 | Inv. |
| 7-23 | B-23 (155) | MEK (80) | B-4 (219) | H-10 (6.90) | 1.41 | 102 | 3.33 | 0.208 | 81 | 80 | 74 | Inv. |
| 7-24 | B-23 (155) | MEK/THF = 8/2 (80) | B-9 (173) | H-10 (5.45) | 1.12 | 102 | 3.33 | 0.207 | 70 | 69 | 64 | Inv. |
| 7-25 | B-23 (155) | MEK/THF = 8/2 (80) | B-15 (142) | H-10 (4.50) | 0.92 | 103 | 3.31 | 0.208 | 69 | 67 | 63 | Inv. |
| 7-26 | B-23 (155) | MEK/THF = 8/2 (80) | B-16 (153) | H-10 (4.85) | 0.99 | 102 | 3.32 | 0.208 | 69 | 68 | 66 | Inv. |
| 7-27 | B-24 (260) | MEK (80) | B-3 (198) | H-10 (6.25) | 0.76 | 98 | 3.18 | 0.208 | 73 | 71 | 67 | Inv. |
| 7-28 | B-24 (260) | MEK (80) | B-4 (219) | H-10 (6.90) | 0.84 | 98 | 3.19 | 0.207 | 75 | 73 | 69 | Inv. |
| 7-29 | B-24 (260) | MEK/THF = 8/2 (80) | B-9 (173) | H-10 (5.45) | 0.67 | 97 | 3.17 | 0.207 | 66 | 64 | 59 | Inv. |
| 7-30 | B-24 (260) | MEK/THF = 8/2 (80) | B-15 (142) | H-10 (4.50) | 0.55 | 97 | 3.18 | 0.208 | 65 | 63 | 58 | Inv. |
| 7-31 | B-24 (260) | MEK/THF = 8/2 (80) | B-16 (153) | H-10 (4.85) | 0.59 | 97 | 3.18 | 0.208 | 64 | 63 | 60 | Inv. |

*1: Stearic acid; *2: Arachidic acid; *3: Behenic acid
A: hydroxyl value; B: hydroxyl value
MEK: methyl ethyl ketone; THF: tetrahydroxyfurane
H-10: adduct of trimethylolpropane (1 mole) and tolylenediisocyanate (3 mole)
H-11: isocyanurate trimer of tolylenediisocyanate
H-12: 2-isicyanatoethyl-2,6-diisocyanatocaproate

Example 8

Image forming material samples used in Examples 5 to 7, which were previously aged under the light-shielding at room temperature (23° C., 55% RH) for 72 hrs., were imagewise exposed from the image forming layer side by laser scanning according to the following imaging processes 1 to 4 and thermally developed at 127° C. for 14.5 sec. using an automatic processor having a heat-drum, while bringing the protective layer surface of the image forming material into contact with the drum surface. There was employed an automatic processor, which was provided with a heating drum having a surface rubber hardness of 70, as defined in JIS K6253 Type A.

Imaging Process 1

Image forming material was subjected to laser scanning exposure from the protective layer side, using an exposure apparatus having a light source of 810 nm semiconductor laser. Laser scanning exposure was conducted at an angle of 90.0° between the photothermographic material surface and a laser beam in the main scanning direction and the sub-scanning direction, at laser spot diameters of 75.0 μm in the main scanning direction and 75.0 μm in the sub-scanning direction and at laser scanning pitches of 65.0 μm in the main scanning direction and 65.0 μm in the sub-scanning direction.

Imaging Process 2

Image forming material was subjected to laser scanning exposure from the protective layer side, using an exposure apparatus having a light source of 810 nm semiconductor laser. Laser scanning exposure was conducted at an angle of 70.0° between the photothermographic material surface and a laser beam in the main scanning direction and 90.0° in sub-scanning direction, at laser spot diameters of 75.4 μm in the main scanning direction and 75.0 μm in the sub-scanning direction and at laser scanning pitches of 65.0 μm in the main scanning direction and 65.0 μm in the sub-scanning direction.

Imaging Process 3

Image forming material was subjected to laser scanning exposure from the protective layer side, using an exposure apparatus having a light source of 800 to 820 nm semiconductor laser of a longitudinal multi-mode, which was made by means of high frequency overlapping. Laser scanning exposure was conducted at an angle of 90.0° between the photothermographic material surface and a laser beam in the main scanning direction and in the sub-scanning direction, at laser spot diameters of 75.0 μm in the main scanning direction and 75.0 μm in the sub-scanning direction and at laser scanning pitches of 65.0 μm in the main scanning direction and 65.0 μm in the sub-scanning direction.

Imaging Process 4

Image forming material was subjected to laser scanning exposure from the protective layer side, using an exposure apparatus having a light sources of two 810 nm semiconductor lasers, in which two laser lights emitted from a light source unit are deflection-scanned with a polygon mirror and an image is formed on the photoreceptor through an fθ lens. Laser scanning exposure was conducted at an angle between the image material surface and a laser beam was 85.0° in the main scanning direction for one laser light and 95.0° in the main scanning direction and 90.0° in the sub-scanning direction from another one, at laser spot diameters of 75.0 μm in the main scanning direction and 75.0 μm in the sub-scanning direction and at laser scanning pitches of 65.0 μm in the main scanning direction and 65.0 μm in the sub-scanning direction. Exposure energy on the protective layer surface was identical and the energy intensity was ½ of the image recording 1.

Interference fringes of obtained images were evaluated according to the following sensor test and densitometry (ΔD). Results thereof are shown in Table 8.

Sensory Test

An image obtained by subjected photothermographic material to exposure and development so as to give a density of 2.00±0.15 was placed on a viewing box exhibiting a luminance of 10000 and extents of causing interference fringes were visually evaluated, based on the following ranks:

4: no interference fringe was observed;

3: interference fringes were slightly observed;

2: marked interference fringes were partially observed;

1: marked interference fringes were overall observed.

Densitometry (ΔD)

In cases where interference fringes are clearly observed, using a densitometer provided with an adjustable slit opening, image densities are subjected to scanning densitometry to quantitative evaluate the interference fringes as a difference in density between bright and dark fringes. Thus, a photothermographic material was exposed and developed so as to have an image density of 1.80+0.15 and five portions of the obtained image were measured at intervals of 25 m over a length of 20 mm (total measuring points of 4,000) and a density difference (ΔD), as defined below was determined and related with the foregoing sensory test results. The less ΔD value indicates that occurrence of interference fringes is less.

D=(maximum density among measured points)−(minimum density amount measured points).

TABLE 8

| Image Forming Material | Imaging Process | Interference Fringe Sensor Test | Interference Fringe ΔD |
|---|---|---|---|
| 5-5 | 1 | 3 | 0.028 |
| 5-5 | 2 | 4 | 0.019 |
| 5-5 | 3 | 4 | 0.016 |
| 5-5 | 4 | 4 | 0.013 |
| 6-8 | 1 | 3 | 0.027 |
| 6-8 | 2 | 4 | 0.019 |
| 6-8 | 3 | 4 | 0.015 |
| 6-8 | 4 | 4 | 0.013 |
| 6-14 | 1 | 3 | 0.027 |
| 6-14 | 2 | 4 | 0.018 |
| 6-14 | 3 | 4 | 0.015 |
| 6-14 | 4 | 4 | 0.012 |
| 6-18 | 1 | 3 | 0.028 |
| 6-18 | 2 | 4 | 0.018 |
| 6-18 | 3 | 4 | 0.016 |
| 6-18 | 4 | 4 | 0.013 |
| 6-22 | 1 | 3 | 0.029 |
| 6-22 | 2 | 4 | 0.017 |
| 6-22 | 3 | 4 | 0.015 |
| 6-22 | 4 | 4 | 0.013 |

As apparent from Table 8, it was shown that superior images were obtained without causing an interference fringe. By the combination of image forming material according to this invention with the imaging process 2, 3 or 4.

What is claimed is:

1. An image forming material comprising a support having thereon an image forming layer containing a light-insensitive organic silver salt and a reducing agent and a protective layer in that order, wherein the image forming layer or the protective layer contains a binder having a structure unit represented by the following formula (1) or (2):

formula (1)

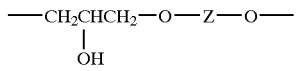

formula (2)

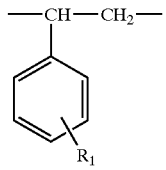

wherein Z is a divalent linkage group, $R_1$ is a hydroxyl group, an alkyl group containing a hydroxyl group or an aryl group containing a hydroxyl group.

2. The image forming material of claim 1, wherein in formula (1), Z is represented by the following formula (3):

formula (3)

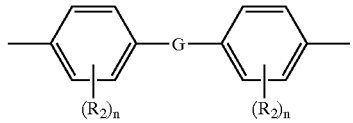

wherein G is —O—, —S—, —SO—, —$SO_2$—, —CO—, an alkylene group or an arylene group; $R_2$ is a hydrogen atom, a halogen atom, an alkyl group or an aryl group, or G and $R_2$ combine with each other to form a ring; n is an integer of 0 to 4.

3. The image forming material of claim 2, wherein the formula (3) is represented by the following formula (4):

formula (4)

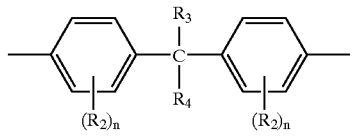

wherein $R_3$ and $R_4$ represent a substituted or unsubstituted alkyl or aryl group, provided that $R_3$ and $R_4$ may combine with each other to form a ring; $R_2$ represents a hydrogen atom, a halogen atom, an alkyl group or an aryl group, or $R_2$ and $R_3$, or $R_2$ and $R_4$ combine with each other to form a ring; n is an integer of 0 to 4.

4. The image forming material of claim 1, wherein the protective layer contains the binder having a structure unit represented by formula (1) or (2).

5. The image forming material of claim 4, wherein said binder contained in the protective layer exhibits a solubility parameter (δp) within the following range:

$$21.5 \leqq \delta p \leqq 29.0.$$

6. The image forming material of claim 5, wherein the protective layer further contains a cross-linking agent meeting the following requirement:

$0.8 \leqq \delta h/\delta p \leqq 1.3$.

7. The image forming material of claim 6, wherein the cross-linking agent is an isocyanate compound.

8. The image forming material of claim 4, wherein said binder contained in the protective layer exhibits a hydroxyl value of 150 to 350 mg KOH/g.

9. The image forming material of claim 8, wherein the image forming layer contains a binder exhibiting a hydroxyl value of 100 to 300 mg KOH/g.

10. The image forming material of claim 9, wherein the following requirement is met:

$0.5 \leqq B/A \leqq 3.5$ wherein A represents a hydroxyl value of said binder contained in the image forming layer and B represents a hydroxyl value of said binder contained in the protective layer.

11. The image forming material of claim 1, wherein the image-forming layer further contains a light-sensitive silver halide.

12. The image forming material of claim 11, wherein the silver halide is spectrally sensitized with a sensitizing dye having an absorption maximum at a wavelength falling within the range of 600 to 1100 nm.

* * * * *